US009687859B2

(12) United States Patent
Kajuch

(10) Patent No.: US 9,687,859 B2
(45) Date of Patent: Jun. 27, 2017

(54) SHOWER DEVICE

(71) Applicant: Kohler Co., Kohler, WI (US)

(72) Inventor: Pete Kajuch, Brookfield, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 14/080,432

(22) Filed: Nov. 14, 2013

(65) Prior Publication Data

US 2014/0138461 A1 May 22, 2014

Related U.S. Application Data

(60) Provisional application No. 61/727,483, filed on Nov. 16, 2012.

(51) Int. Cl.
*B05B 1/16* (2006.01)
*B05B 1/18* (2006.01)

(52) U.S. Cl.
CPC ..... *B05B 1/1645* (2013.01); *B05B 1/169* (2013.01); *B05B 1/1636* (2013.01); *B05B 1/1654* (2013.01); *B05B 1/18* (2013.01)

(58) Field of Classification Search
CPC ... B05B 1/1636; B05B 1/1645; B05B 1/1654; B05B 1/169; B05B 1/18; B05B 1/185
USPC ..... 239/393, 394, 443, 447, 449, 540, 548, 239/553.5, 556–562, 567
See application file for complete search history.

(56) References Cited

U.S. PATENT DOCUMENTS 3,088,675 A 5/1963 Bone
3,608,650 A 9/1971 Matsusaka
3,944,140 A 3/1976 Caton et al.
3,963,179 A 6/1976 Tomaro
4,272,022 A 6/1981 Evans
D267,581 S 1/1983 Mackay et al.
4,545,083 A 10/1985 Searson
4,561,593 A 12/1985 Cammack et al.
(Continued)

FOREIGN PATENT DOCUMENTS

CN 1761528 A 4/2006
CN 202045027 U 11/2011
(Continued)

OTHER PUBLICATIONS

United States Patent Office Notice of Allowance for U.S. Appl. No. 29/450,323 dated Jun. 26, 2014 (8 pages).
(Continued)

*Primary Examiner* — Arthur O Hall
*Assistant Examiner* — Cody Lieuwen
(74) *Attorney, Agent, or Firm* — Michael Best & Friedrich

(57) ABSTRACT

A multi-mode shower device. The shower device may provide an aerated spray mode and a non-aerated spray mode. The spray engine may include an elastomeric layer providing a spray face and defining an outlet and a support layer defining an opening, material of the elastomeric layer extending from the spray face and through the opening to provide an integrated seal on the opposite surface of the support layer. A conduit to one shower mode outlet may pass through a plenum for another shower mode, the conduit being completely surrounded by the plenum as the conduit passes through the plenum. The shower device may include a valve having a valve body defining a valve port in fluid communication with the inlet and a mode isolator adjacent the valve port.

17 Claims, 33 Drawing Sheets

(56) References Cited

U.S. PATENT DOCUMENTS

| | | | | |
|---|---|---|---|---|
| 4,618,100 | A | 10/1986 | White et al. | |
| 4,733,818 | A | 3/1988 | Aghnides | |
| 4,733,819 | A | 3/1988 | Aghnides | |
| 4,964,181 | A | 10/1990 | Alpert | |
| 4,998,673 | A | 3/1991 | Pilolla | |
| 5,215,258 | A | 6/1993 | Jursich | |
| 5,228,625 | A | 7/1993 | Grassberger | |
| 5,329,650 | A | 7/1994 | Zaccai et al. | |
| 5,405,089 | A | 4/1995 | Heimann et al. | |
| 5,518,181 | A | 5/1996 | Shames et al. | |
| 5,535,779 | A | 7/1996 | Huang | |
| 5,664,015 | A | 9/1997 | Ford et al. | |
| 5,702,057 | A * | 12/1997 | Huber | B05B 15/0291 239/288.3 |
| 5,730,362 | A * | 3/1998 | Cordes | 239/123 |
| 5,779,146 | A | 7/1998 | Cutler | |
| 5,862,985 | A | 1/1999 | Neibrook et al. | |
| 6,021,960 | A | 2/2000 | Kehat | |
| D423,083 | S | 4/2000 | Haug et al. | |
| D424,160 | S | 5/2000 | Haug et al. | |
| D424,161 | S | 5/2000 | Haug et al. | |
| D424,162 | S | 5/2000 | Haug et al. | |
| D424,163 | S | 5/2000 | Haug et al. | |
| D424,164 | S | 5/2000 | Haug et al. | |
| 6,061,457 | A | 5/2000 | Stockhamer | |
| D428,110 | S | 7/2000 | Haug et al. | |
| 6,090,210 | A | 7/2000 | Balance et al. | |
| 6,126,290 | A | 10/2000 | Veigel | |
| D439,305 | S | 3/2001 | Slothower | |
| D440,277 | S | 4/2001 | Slothower | |
| D440,278 | S | 4/2001 | Slothower | |
| D443,027 | S | 5/2001 | Kollmann et al. | |
| D443,029 | S | 5/2001 | Kollmann et al. | |
| 6,263,524 | B1 | 7/2001 | Abdul | |
| D457,598 | S | 5/2002 | Storti et al. | |
| 6,439,472 | B1 | 8/2002 | Lin et al. | |
| 6,444,039 | B1 | 9/2002 | Nguyen | |
| 6,463,658 | B1 | 10/2002 | Larsson | |
| D465,263 | S | 11/2002 | Tse | |
| D465,551 | S | 11/2002 | Tse | |
| D466,188 | S | 11/2002 | Tse | |
| D489,793 | S | 5/2004 | Haug et al. | |
| D492,004 | S | 6/2004 | Haug et al. | |
| D492,006 | S | 6/2004 | Haug et al. | |
| D492,008 | S | 6/2004 | Haug et al. | |
| D495,776 | S | 9/2004 | Blomstrom | |
| D497,974 | S | 11/2004 | Haug et al. | |
| D498,514 | S | 11/2004 | Haug et al. | |
| 6,879,818 | B2 | 4/2005 | Wageneck | |
| D506,924 | S | 7/2005 | Berner | |
| D509,424 | S | 9/2005 | Berner | |
| D511,809 | S | 11/2005 | Haug et al. | |
| D513,525 | S | 1/2006 | Haug et al. | |
| 6,983,898 | B2 | 1/2006 | Clark | |
| D518,145 | S | 3/2006 | Nikles | |
| 7,048,210 | B2 | 5/2006 | Clark | |
| D527,072 | S | 8/2006 | Wu | |
| 7,100,845 | B1 | 9/2006 | Hsieh | |
| 7,111,798 | B2 | 9/2006 | Thomas et al. | |
| 7,178,746 | B2 | 2/2007 | Gross | |
| D551,737 | S | 9/2007 | Haug et al. | |
| 7,269,862 | B2 | 9/2007 | Rooke et al. | |
| D557,763 | S | 12/2007 | Schönherr et al. | |
| D557,764 | S | 12/2007 | Schönherr et al. | |
| D557,765 | S | 12/2007 | Schönherr et al. | |
| D562,937 | S | 2/2008 | Schönherr et al. | |
| D562,938 | S | 2/2008 | Blessing | |
| D564,067 | S | 3/2008 | Lammel et al. | |
| D576,251 | S | 9/2008 | Schönherr et al. | |
| D590,477 | S | 4/2009 | Schoenherr et al. | |
| D590,916 | S | 4/2009 | Schoenherr et al. | |
| D590,917 | S | 4/2009 | Schoenherr et al. | |
| D592,276 | S | 5/2009 | Schoenherr et al. | |
| 7,578,453 | B1 | 8/2009 | Wilson | |
| D610,230 | S | 2/2010 | Wu et al. | |
| D610,231 | S | 2/2010 | Wu et al. | |
| D610,651 | S | 2/2010 | Wu et al. | |
| 7,740,186 | B2 | 6/2010 | Macan et al. | |
| 7,762,479 | B2 | 7/2010 | Li | |
| D630,706 | S | 1/2011 | Giggs et al. | |
| 7,918,408 | B2 | 4/2011 | Tshieh | |
| D638,100 | S | 5/2011 | Juan | |
| 7,946,512 | B2 | 5/2011 | Schorn | |
| 8,028,935 | B2 * | 10/2011 | Leber | 239/436 |
| 8,048,010 | B2 | 11/2011 | Ohashi et al. | |
| D655,383 | S | 3/2012 | Flowers et al. | |
| D659,797 | S | 5/2012 | Farley | |
| D667,928 | S | 9/2012 | Cutler et al. | |
| D669,157 | S | 10/2012 | Flowers et al. | |
| D670,358 | S | 11/2012 | Bai | |
| D672,011 | S | 12/2012 | Andrew et al. | |
| D672,433 | S | 12/2012 | Yoo et al. | |
| D680,619 | S | 4/2013 | Zhadanov | |
| D681,776 | S | 5/2013 | Cutler et al. | |
| D692,527 | S | 10/2013 | Hanna et al. | |
| D694,361 | S | 11/2013 | Schoenherr et al. | |
| D707,329 | S | 6/2014 | Hanna et al. | |
| D714,421 | S | 9/2014 | Flowers et al. | |
| D719,240 | S | 12/2014 | Hanna et al. | |
| D737,931 | S | 9/2015 | Schoenherr et al. | |
| 2003/0029936 | A1 | 2/2003 | Clark | |
| 2004/0164184 | A1 | 8/2004 | Glunk | |
| 2004/0217209 | A1 * | 11/2004 | Bui | 239/548 |
| 2004/0250851 | A1 | 12/2004 | Clark | |
| 2004/0251323 | A1 | 12/2004 | Clark | |
| 2005/0156062 | A1 | 7/2005 | Thomas et al. | |
| 2006/0175437 | A1 | 8/2006 | Gross | |
| 2007/0246577 | A1 * | 10/2007 | Leber | 239/589 |
| 2008/0011880 | A1 | 1/2008 | Butzke et al. | |
| 2009/0114743 | A1 | 5/2009 | Thomas et al. | |
| 2010/0037389 | A1 | 2/2010 | Gross | |
| 2010/0065665 | A1 | 3/2010 | Whitaker et al. | |
| 2011/0073678 | A1 * | 3/2011 | Qiu et al. | 239/451 |
| 2011/0139905 | A1 * | 6/2011 | Chen et al. | 239/562 |
| 2012/0104114 | A1 | 5/2012 | Zhou et al. | |
| 2013/0126646 | A1 * | 5/2013 | Wu | 239/589 |

FOREIGN PATENT DOCUMENTS

| | | |
|---|---|---|
| CN | 203408809 U | 1/2014 |
| DE | 10108248 | 8/2002 |
| EP | 0348359 | 12/1989 |
| EP | 0435030 A2 | 7/1991 |
| EP | 1479445 | 1/2004 |
| EP | 2638972 | 9/2013 |
| GB | 2337471 | 11/1999 |
| WO | 9718041 | 5/1997 |

OTHER PUBLICATIONS

United States Patent Office Notice of Allowance for U.S. Appl. No. 29/450,310 dated Jun. 25, 2014 (8 pages).

United States Patent Office Notice of Allowance for U.S. Appl. No. 29/450,306 dated Jun. 26, 2014 (8 pages).

Shower head photos, known at least as early as Mar. 12, 2012.

EP13158845.1 Extended European Search Report dated May 24, 2013 (7 pages).

Co-pending U.S. Appl. No. 29/450,323, filed Mar. 16, 2013.

Co-pending U.S. Appl. No. 29/450,310, filed Mar. 15, 2013.

Co-pending U.S. Appl. No. 29/450,306, filed Mar. 15, 2013.

Co-pending U.S. Appl. No. 29/457,990, filed Jun. 14, 2013.

United States Patent Office Notice of Allowance for U.S. Appl. No. 29/415,587 dated Jun. 7, 2013 (7 pages).

United States Patent Office Supplemental Notice of Allowance for U.S. Appl. No. 29/457,990 dated Sep. 24, 2013 (7 pages).

Co-pending U.S. Appl. No. 13/790,621, filed Mar. 8, 2013.

Co-pending U.S. Appl. No. 29/467,020, filed Sep. 13, 2013.

United States Patent Office Notice of Allowance for U.S. Appl. No. 29/470,413 dated Jan. 31, 2014 (16 pages).

Australian Patent Office Examination Report for Application No. 2013201441 dated Sep. 17, 2014 (5 pages).

(56) References Cited

OTHER PUBLICATIONS

Extended European Search Report for Application No. 13193218.8 dated Aug. 27, 2014 (14 pages).
United States Patent Office Notice of Allowance for U.S. Appl. No. 29/465,138 dated Aug. 5, 2014 (8 pages).
VS-3014 Caspian Showerhead, downloaded Jun. 27, 2014 http://www.speakmancompany.com/products/detail/VS-3014 (1 page).
Grohe Power & Soul (5 pages).
Partial European Search Report from the European Patent Office for European Application No. 13193218.8-1760 dated Apr. 17, 2014 (7 pages).
1st Office Action from The State Intellectual Property Office of the People's Republic of China for Application No. 201310077786.2 dated Jun. 3, 2015 (7 pages).
Office Action from the United States Patent and Trademark Office for U.S. Appl. No. 13/790,621 dated Jul. 2, 2015 (43 pages).
Examination Report from the Canadian Intellectual Property Office for Application No. 2,808,941 dated Mar. 11, 2015 (5 pages).
2nd Office Action from the Patent Office of the Peoples Republic of China for Application No. 201310077786.2 dated Jan. 21, 2016 (10 pages).
Notice of Allowance from the United States Patent and Trademark Office for U.S. Appl. No. 29/567,006 dated Oct. 4, 2016 (6 pages).
Notice of Allowance from the United States Patent and Trademark Office for U.S. Appl. No. 29/566,805 dated Oct. 13, 2016 (8 pages).
Notice of Allowance from the United States Patent and Trademark Office for U.S. Appl. No. 29/567,003 dated Oct. 13, 2016 (8 pages).
Notice of Allowance from the United States Patent and Trademark Office for U.S. Appl. No. 29/567,018 dated Oct. 11, 2016 (8 pages).

* cited by examiner

Fully in Mode

Mode 90%

SHOWER DEVICE

RELATED APPLICATION

The present application claims priority to U.S. Patent Application No. 61/727,483, filed Nov. 16, 2012, the entire contents of which are hereby incorporated by reference.

FIELD

The present invention generally relates to shower devices and, more particularly, to a spray engine for a shower device.

SUMMARY

In one independent aspect, a multi-mode shower device may include a housing defining an inlet connectable to a water supply and a plurality of housing ports in fluid communication with the inlet; and a spray engine supported for infinite rotation relative to the housing to change a mode of the shower device, the spray engine providing a spray face having a first outlet and a second outlet, the spray engine defining a radial outer surface and at least a portion of a rear surface of the shower device opposite the spray face, elastomeric material being provided on the spray face, the radial outer surface and the portion of the rear surface, the spray engine defining a first of set of inlet ports and a second set of inlet ports, each set of inlet ports including a plurality of inlet ports corresponding to the plurality of housing ports.

In some constructions, the spray face, the radial outer surface and a first portion of the rear surface of the shower device are formed as a single layer of elastomeric material. A second portion of the rear surface of the shower device provided by the spray engine may be formed of an elastomeric material and is separate from the single layer.

In some constructions, the plurality of housing ports includes at least two housing ports (e.g., three housing ports), and each of the first set of inlet ports and the second set of inlet ports includes a corresponding at least two inlet ports (e.g., three inlet ports). The spray engine may change between the first shower mode and the second shower mode more at least two times (e.g., three times) in each 360 degree rotation of the spray engine relative to the housing. For example, in some constructions, the shower device includes four different spray modes, and, in such constructions, the four different spray modes may change three times in a full rotation, with the spray modes changing every 30 degrees.

In another independent aspect, a multi-mode shower device may include a housing defining an inlet connectable to a water supply; a valve including a valve body defining a valve port in fluid communication with the inlet, the valve body including a mode isolator adjacent the valve port; and a spray engine supported for pivoting movement relative to the valve to change a mode of the shower device, the spray engine providing a spray face having a first outlet and a second outlet, the spray engine defining a first inlet port and a second inlet port.

In a first shower mode position of the spray face relative to the valve, the first inlet port is aligned with the valve port to provide a first shower mode through the first outlet and the second inlet port is misaligned with the valve port and at least partially aligned with the mode isolator to substantially prevent flow through the second outlet. In a second shower mode position of the spray face relative to the valve, the second inlet port is aligned with the valve port to provide a second shower mode through the second outlet and the first inlet port is misaligned with the valve port. In an intermediate shower mode position of the spray face relative to the valve, the first inlet port is at least partially aligned with the valve port to provide the first shower mode through the first outlet and the second inlet port is at least partially aligned with the valve port to provide the second shower mode through the second outlet.

The valve may also include a pair of mode isolators flanking the at least one port and an integrated spill cover adjacent at least one of the mode isolators. The at least one port, the mode isolators and the integrated spill cover may be defined by at least one raised sealing surface. In some constructions, the valve has more than one port (e.g., three ports), and a pair of mode isolators flanks each port. A spill cover may be provided between adjacent mode isolators. The port(s), the mode isolator(s) and the spill cover(s) are positioned about a circumference of the valve.

In yet another independent aspect, a multi-mode shower device may include a housing defining an inlet connectable to a water supply and a housing port in fluid communication with the inlet; and a spray engine supported by the housing and operable to change a mode of the shower device, the spray engine providing a spray face having a first outlet and a plurality of second outlets, the plurality of second outlets being arranged in an annular zone on the spray face, the first outlet being positioned in the annular zone, at least one second outlet being positioned radially inwardly of the first outlet and at least one second outlet being positioned radially outwardly of the first outlet, the spray engine defining a first inlet port in fluid communication with the first outlet and a second inlet port in fluid communication with the plurality of second outlets.

In a first shower mode, the first inlet port is aligned with the housing port to provide flow to the first outlet in a first shower mode. In a second shower mode, the second inlet port is aligned with the housing port to provide flow to the second outlet in a second shower mode.

In some constructions, the spray engine is supported for pivoting movement relative to the housing to change a mode of the shower device. The spray engine may define a first passageway communicating between the first inlet port and the first outlet and a plenum communicating between the second inlet port and the second outlet, the first passageway including a conduit passing through the plenum and to the first outlet, the conduit being completely surrounded by the plenum as the conduit passes through the plenum. In a first shower mode position of the spray face relative to the housing, the first inlet port is aligned with the housing port to provide flow through the first passageway to the first outlet in a first shower mode. In a second shower mode position of the spray face relative to the housing, the second inlet port is aligned with the housing port to provide flow through the plenum to the second outlet in a second shower mode.

In some constructions, the shower device includes a distributor having a plurality of fluidly separate chambers for directing fluid to at least one of the first outlet and the second outlet. In such constructions, the first passageway is defined from the fluid supply conduit, through the distributor, and to the first outlet, and the second passageway is defined from the fluid supply conduit, through the distributor, and to the second outlet. In some constructions, the first outlet, corresponding to the first spray mode (e.g., a cyclone spray mode), is surrounded by a plurality of second outlets, corresponding to the second spray mode (e.g., an aerated spray mode). In one construction, each second outlet communicates with a plenum, and the first passageway extends through the plenum.

In a further independent aspect, a multi-mode shower device may include a housing defining an inlet connectable to a water supply and a housing port in fluid communication with the inlet; and a spray engine supported by the housing and operable to change a mode of the shower device between an aerated shower mode and a non-aerated shower mode.

In some constructions, the spray engine is supported for pivoting movement relative to the housing to change a mode of the shower device between the aerated shower mode and the non-aerated shower mode. The spray engine may provide a spray face having a first outlet and a second outlet, and the spray engine may define a first inlet port communicating with the first outlet, a second inlet port, a passageway communicating between the second inlet port and the second outlet and an air inlet in communication with the passageway. In a non-aerated shower mode position of the spray face relative to the housing, the first inlet port is aligned with the housing port to provide non-aerated flow through the first outlet. In an aerated shower mode position of the spray face relative to the housing, the second inlet port is aligned with the housing port to provide aerated flow through the second outlet, water flow through the passageway causing air to be drawn through the air inlet, water and air mixing in the passageway to provide the aerated flow.

In some constructions, the air inlet may communicate directly with atmosphere and receive air to mix with water in the aerated spray mode. The spray engine may be pivotable to adjust the spray mode, and the air inlet may be pivotable with the spray engine during mode adjustment.

In another independent aspect, a faceplate for a shower device may have a surface with a pattern of intersecting lines. A plurality of apertures may extend through the faceplate to allow water to flow therethrough, and at least one aperture may be positioned at an intersection of lines. The pattern may be formed of repeating shapes with edges providing ridges, and at least one aperture may be formed at an intersection of ridges. The pattern may be formed from changes in thickness of the faceplate.

In yet another independent aspect, a combination may generally include a first shower device having a multi-layer first spray face with a base layer and a covering layer and a second shower device having a multi-layer second spray face with a base layer and a covering layer. One layer (e.g., the base layer) may be common to the first spray face and the second spray face, and the other layer (e.g., the covering layer) may be different (e.g., surface pattern, color, graphics, spray modes (certain nozzles provided or not), etc.) between the first spray face and the second spray face.

In a further independent aspect, a shower device may include a housing defining an inlet connectable to a water supply and a housing port in fluid communication with the inlet; and a spray engine defining an inlet port and a conduit communicating with the inlet port, the spray engine including an elastomeric layer providing a spray face and defining an outlet communicating with the conduit, the spray engine including a support layer having a first surface engaging the elastomeric layer and an opposite, second surface, the support layer defining an opening between the first surface and the second surface, material of the elastomeric layer extending from the spray face, through the opening and to the second surface, the material providing an integrated seal on the second surface of the support layer.

Material of the elastomeric layer on the second surface may define at least one of a passage communicating with the conduit, a radial seal against a wall of the conduit, and a face seal between a first passageway including the conduit and a plenum. In some constructions, material of the elastomeric layer on the second surface defines a passage communicating with the conduit, and material defining the passage may provide a radial seal against a wall of the conduit. In some constructions, the shower device includes a multi-mode shower device, and the material may provide a face seal between the passage and conduit of one shower mode and a plenum for another shower mode.

Independent aspects of the invention will become apparent by consideration of the detailed description, claims and accompanying drawings.

DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

Figure 1:
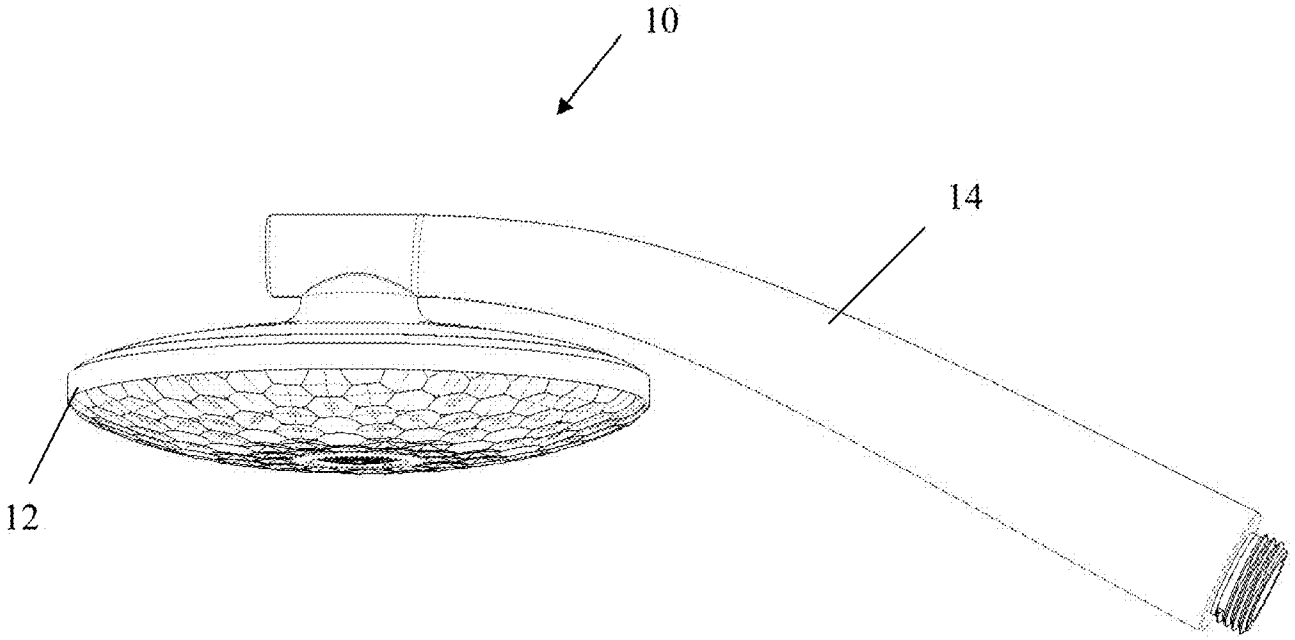
FIG. 1 is a side view of a shower device, such as a hand shower.
Figure 2:
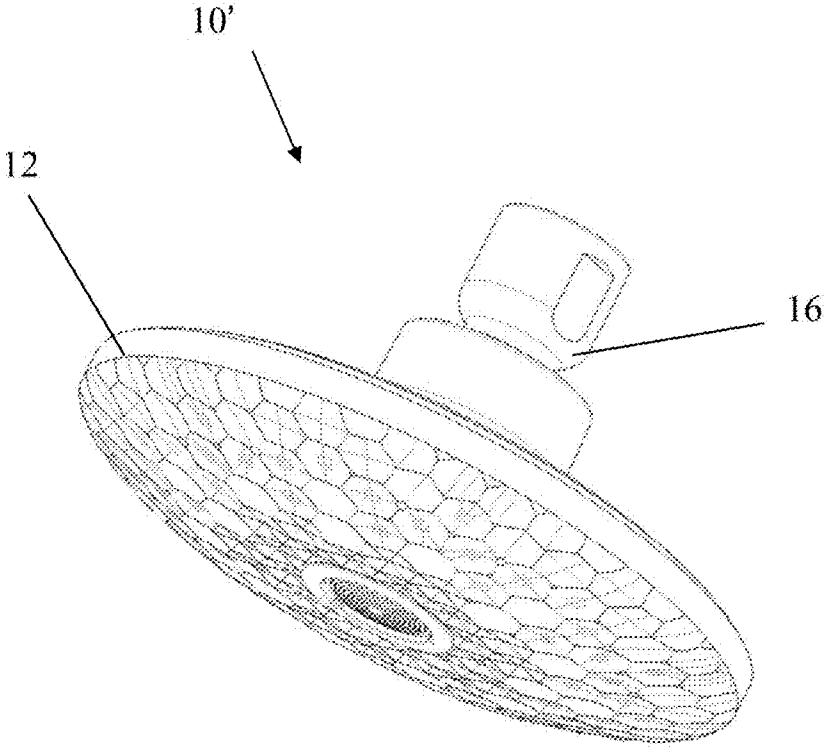
FIG. 2 is a perspective view of an alternative construction of a shower device, such as a shower head.
Figure 11:
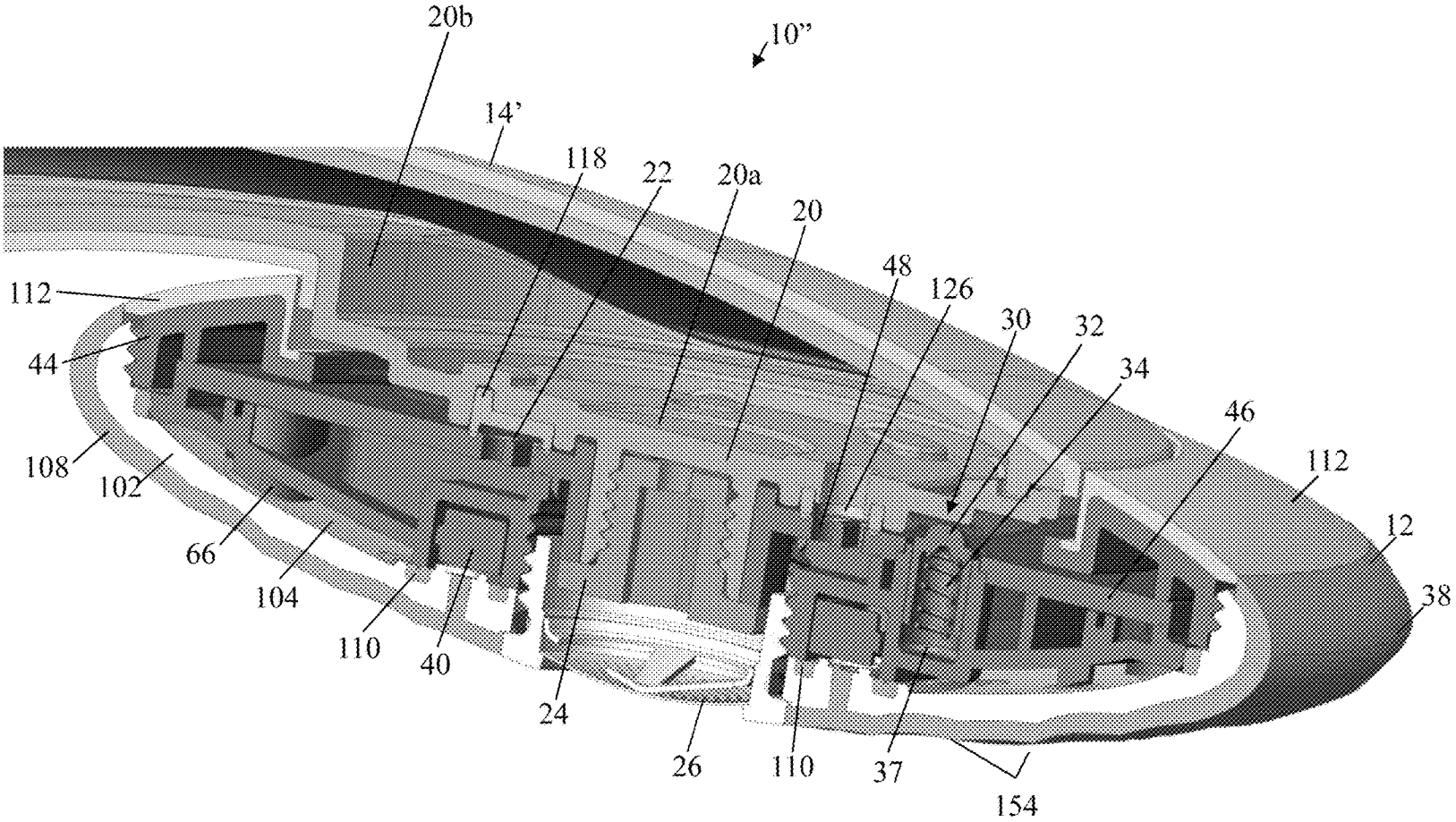
FIG. 11 is a cross-sectional view of another construction of a shower device, such as a hand shower.

FIG. 1 illustrates a shower device 10, such as a hand shower, having a spray engine 12, described in greater detail below. As shown in FIG. 1, the illustrated shower device 10 includes a handle 14 and is a hand shower. FIG. 11 illustrates an alternative construction of a hand shower including an alternative handle 14". FIG. 2 illustrates an alternative shower device 10', such as a shower head, with the spray engine 12 coupled with a ball swivel 16. In other constructions (not shown), the spray engine 12 may be coupled with other fluid supply mechanisms to form other types of shower devices, such as, for example, a rain can, a wall-mounted water tile, etc.

In the illustrated construction, the spray engine 12 is modular such that the spray engine 12 can be matched with a handle (such as the handle 14) to form a hand shower or with a ball swivel (such as the ball swivel 16) to form a shower head. The spray engine 12 may be matched with other structure to provide other types of shower devices (e.g., a rain can, water tile, etc.). The illustrated spray engine 12 is scalable to both larger and smaller spray engine sizes. The illustrated spray engine 12 is also extensible to support multiple design styles.

Figure 3:
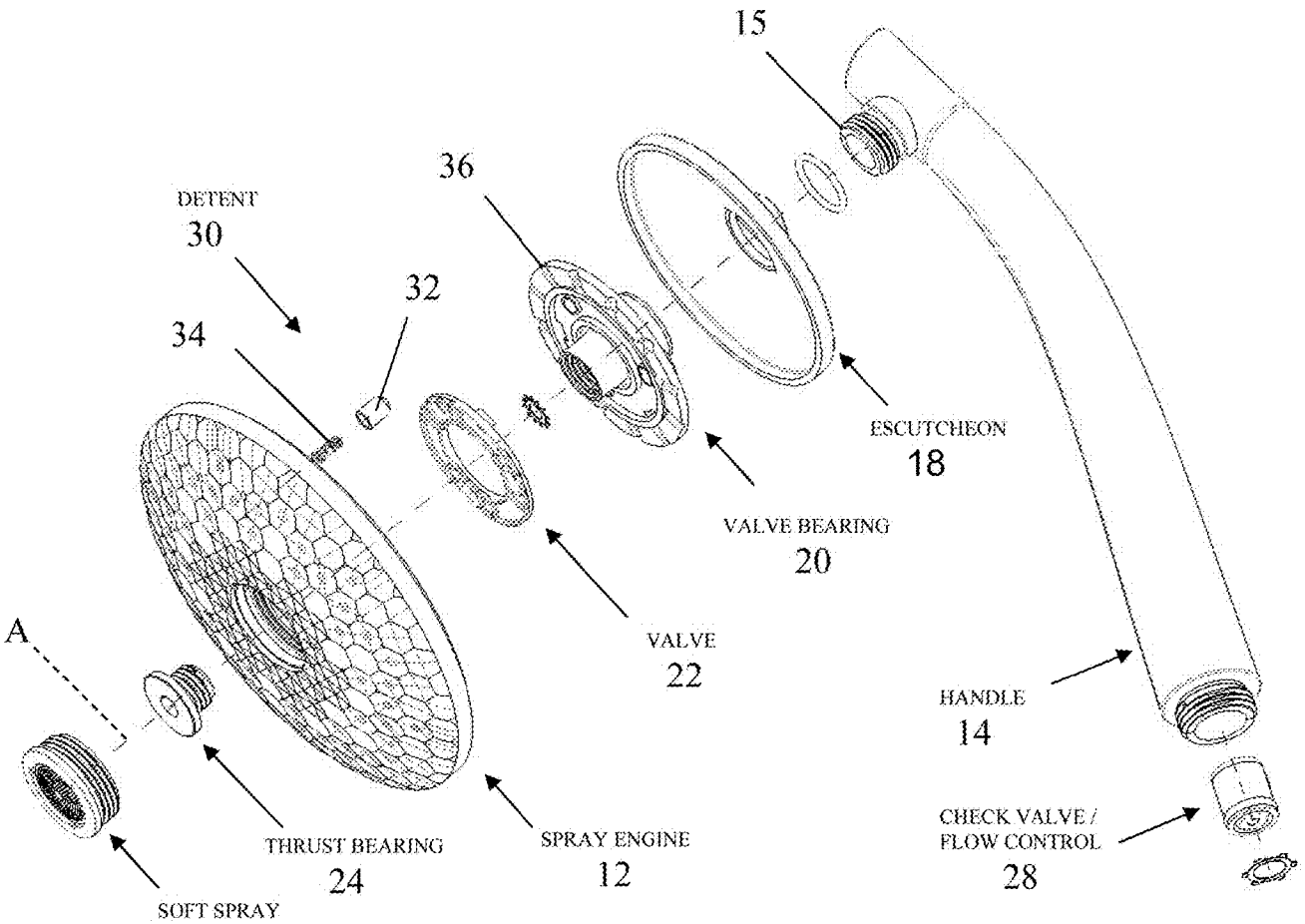
FIG. 3 is an exploded view of the shower device shown in FIG. 1.
Figure 4:
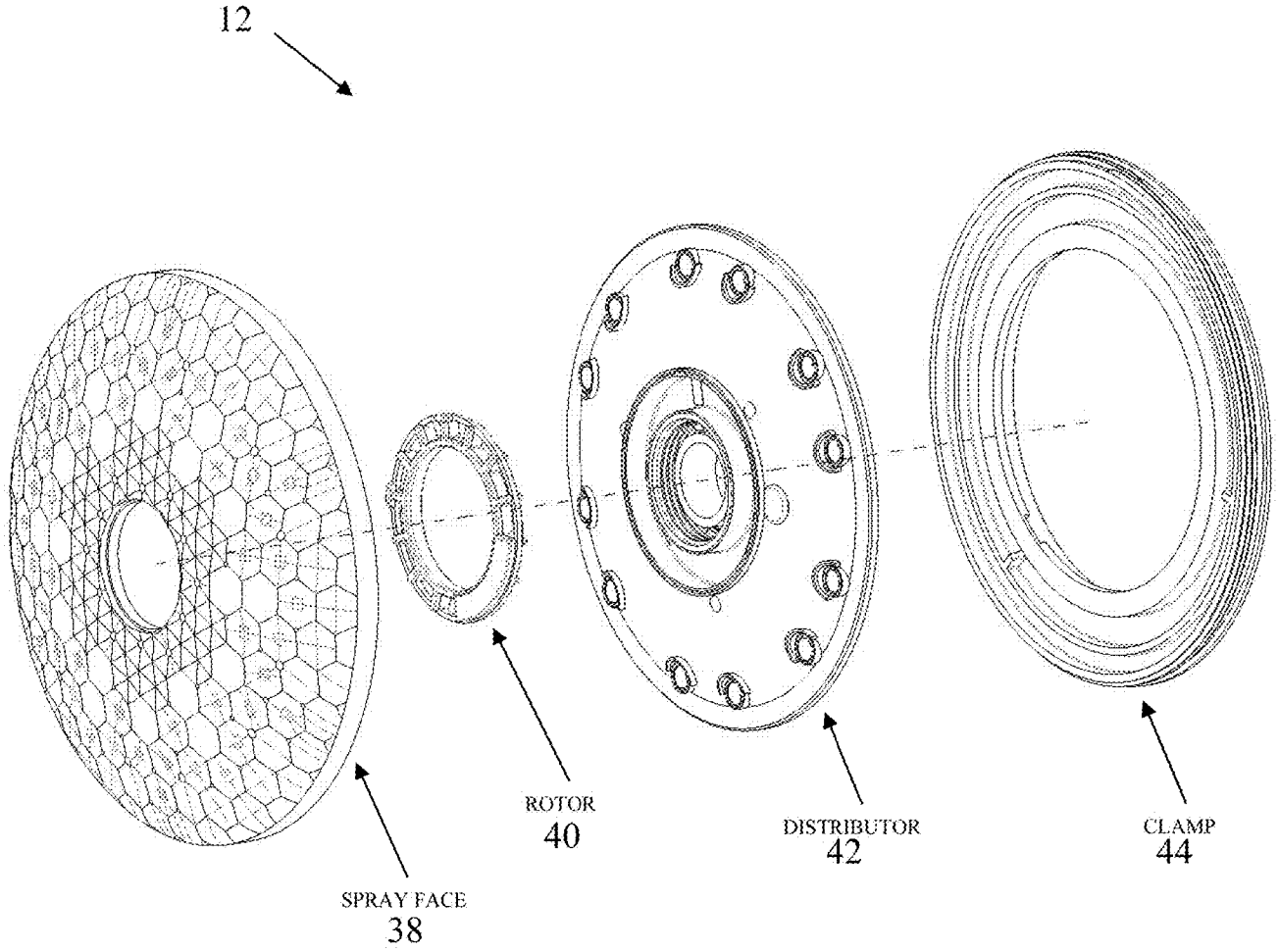
FIG. 4 is an exploded view of a spray engine shown in FIG. 3.

As shown in FIG. 3, the illustrated shower device 10 (for example, the hand shower shown in FIG. 1) includes the spray engine 12, the handle 14 providing an inlet 15, an escutcheon 18, a valve bearing 20, a valve 22, and a thrust bearing 24. The spray engine 12 includes a soft spray member 26 for a soft spray mode. The handle 14 includes a check valve 28, or flow control device, for allowing a flow of fluid to enter the handle 14 and inhibiting a backflow of the fluid from exiting the handle 14. The shower device 10 defines a central longitudinal axis A extending in a direction generally parallel with the flow of fluid out of the shower device 10. As shown in FIG. 4, the spray engine 12 also includes a spray face 38, a rotor 40, a distributor 42 and a clamp 44, described in greater detail below.

In the illustrated construction, the spray engine 12 includes a soft spray mode, a pulse spray mode, an aerated spray mode and a cyclone spray mode. The illustrated spray engine 12 is continuously rotatable (can rotate infinitely in either direction) with respect to the valve bearing 20 and valve 22 to change between various functions, or spray modes, of the shower device 10.

Figure 13:
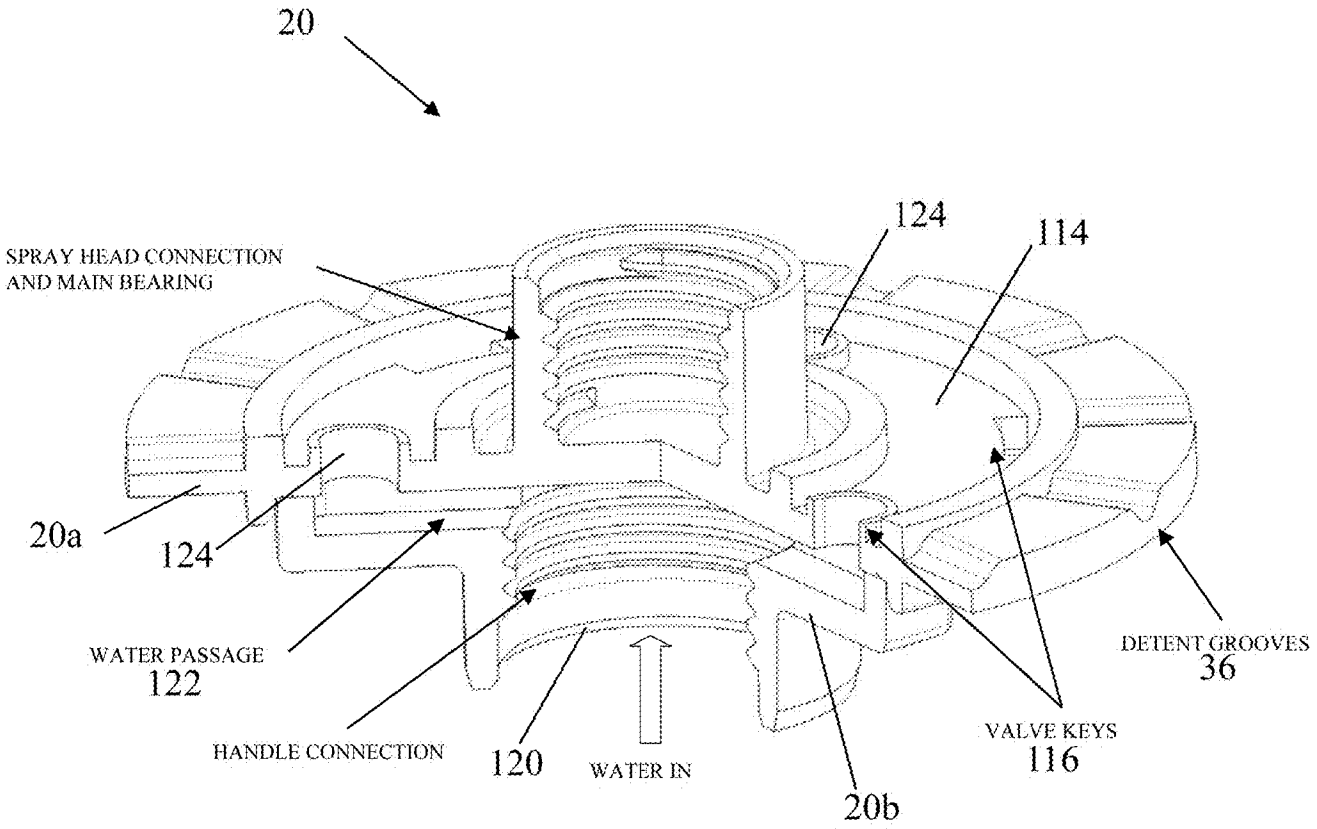
FIG. 13 is a perspective view of a valve bearing shown in FIG. 3, having a section cut out.

A detent mechanism 30 (see FIGS. 3 and 11) is provided between the spray engine 12 and the valve bearing 20 to selectively retain the spray engine 12 in a rotated position associated with a function or spray mode. The detent mechanism 30 includes a detent member 32, a biasing member (e.g., a spring 34) and detent grooves 36 (FIG. 13). The spring 34 is at least partially received in and biases the detent member 32 away from the spray engine 12 and toward the detent grooves 36 on the valve bearing 12 (FIG. 11). The spray engine 12 defines (see FIGS. 5 and 11) a pocket 37 receiving and guiding the spring 34 and the detent member 32.

The detent member 32 engages the detent grooves 36 in the valve bearing 20 to provide tactile feedback and to releasably hold the spray engine 12 in one of a set of discrete rotational positions with respect to the valve bearing 20. In the illustrated construction, the valve bearing 20 includes twelve detent grooves 36 corresponding to twelve discrete rotational positions of the spray engine 12 (described in more detail below). In other constructions, a different number of detent grooves 36 may be employed to provide an associated desired number of discrete rotational positions of the spray engine 12.

Figure 5:
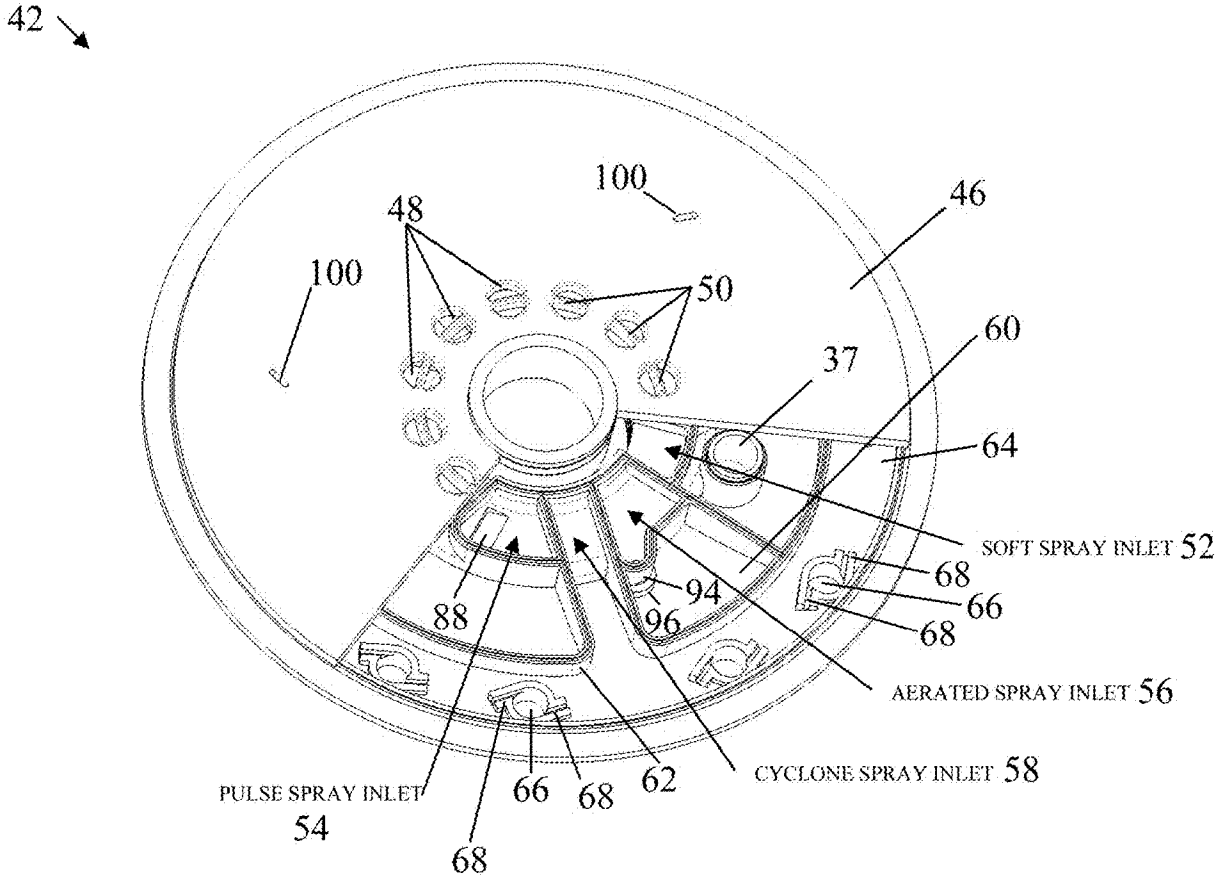
FIG. 5 is a rear perspective view of a distributor shown in FIG. 4, having a one-third portion cut out to show the interior of the distributor.

FIG. 5 illustrates a rear view of the distributor 42, the side of the distributor 42 from which fluid enters the distributor 42. The distributor 42 includes a rear plate 46 (partially cut away to view inside the distributor 42) having a plurality of ports 48. Each of the discrete rotational positions of the spray engine 12 corresponds to one port 48 (e.g., the shower device 10 employs the same number of ports as discrete rotational positions). In the illustrated construction, twelve ports 48 are employed. In other constructions, a different number of ports 48 may be employed, corresponding to the number of discrete rotational positions of the spray engine 12.

Each port 48 includes a bridge 50 spanning across the port 48 to provide structural support for the valve 22 and prevent the valve 22 from falling into the ports 48. The distributor 42 also includes a plurality of discrete inlets for the different functions or spray modes, including, in the illustrated construction, a soft spray inlet 52, a pulse spray inlet 54, an aerated spray inlet 56 and a cyclone spray inlet 58. Each of the ports 48 is aligned with an inlet 52, 54, 56, 58. In the illustrated construction, the distributor 42 includes three of each of the inlets 52, 54, 56, 58. This construction may generally increase the flow area, improve low pressure performance, and/or improve the uniformity of water distribution.

The cutout portion of FIG. 5 illustrates one-third of the internal structure of the distributor 42, which is essentially repeated in each of the other one-third sections of the distributor 42. Thus, one of each inlet 52, 54, 56, 58 is shown in the cutout portion of FIG. 5, and the remaining two of each inlet 52, 54, 56, 58 are not shown. Each inlet 52, 54, 56, 58 is aligned with one of the ports 48. The rear plate 46 is fixedly coupled (e.g., by welding (sonic welding), adhesive, etc.) to walls 62 providing partitions between the inlets 52, 54, 56, 58 to seal off each inlet 52, 54, 56, 58.

The cyclone spray inlets 58 are fluidly connected to each other by an annular cyclone spray chamber 64, which, in the illustrated construction, extends adjacent an outer perimeter of the distributor 42. The annular cyclone spray chamber 64 includes a plurality of cyclone spray passages 66 having diametrically opposed tangential inlets 68 for imparting cyclonic motion of a fluid passing through the cyclone spray passages 66.

Figure 6:
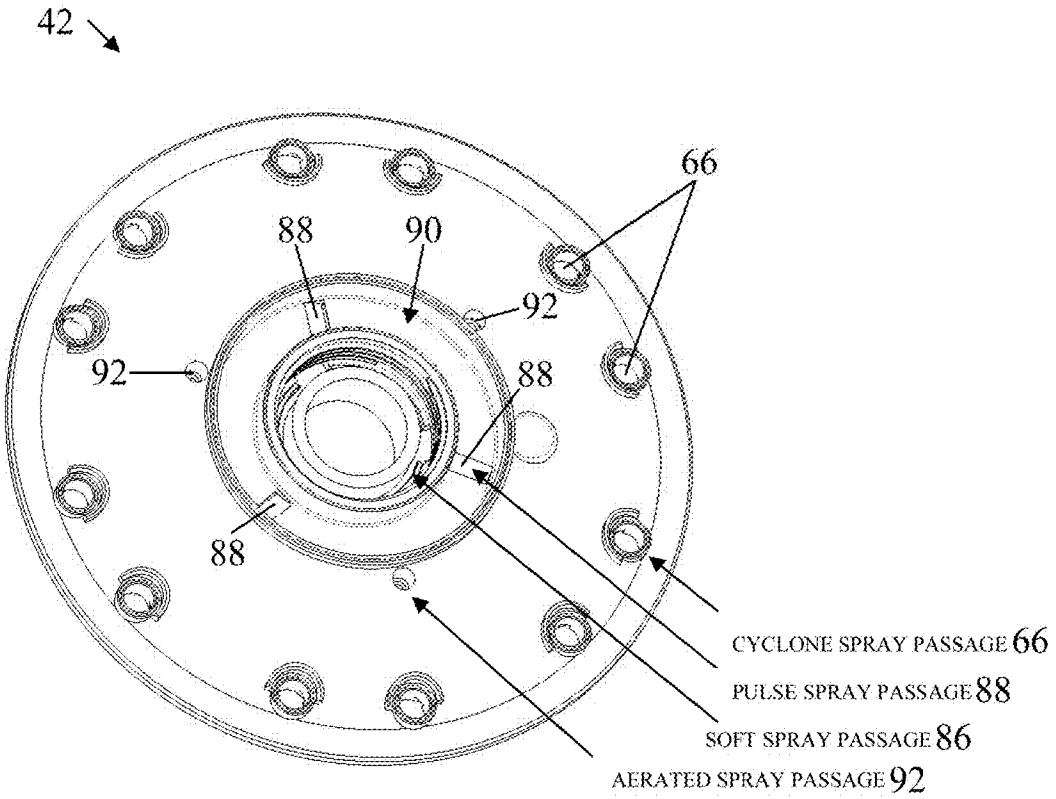
FIG. 6 is a front perspective view of the distributor shown in FIG. 4.

FIG. 6 is a front perspective view of the distributor 42, showing the side from which fluid exits the distributor 42. The soft spray inlets 52 converge in a soft spray passage 86 located centrally on the distributor 42. Each aerated spray inlet 56 is fluidly connected to an aerated spray passage 92.

Each pulse spray inlet 54 communicates with a pulse spray passage 88, and the pulse spray passages 88 flow into an annular chamber 90. Each pulse spray passage 88 is angled in a common circumferential direction to direct fluid into the annular chamber 90 in the circumferential direction (e.g., counterclockwise in FIG. 6). The annular chamber 90 receives the rotor 40 (see FIG. 4), which rotates in the circumferential direction when fluid impinges on the rotor 90. The rotating rotor 40 sequentially blocks, in a circular direction, fluid flow through select pulse spray nozzles 80 (see FIG. 8A), creating a pulsating fluid action.

Figure 7:
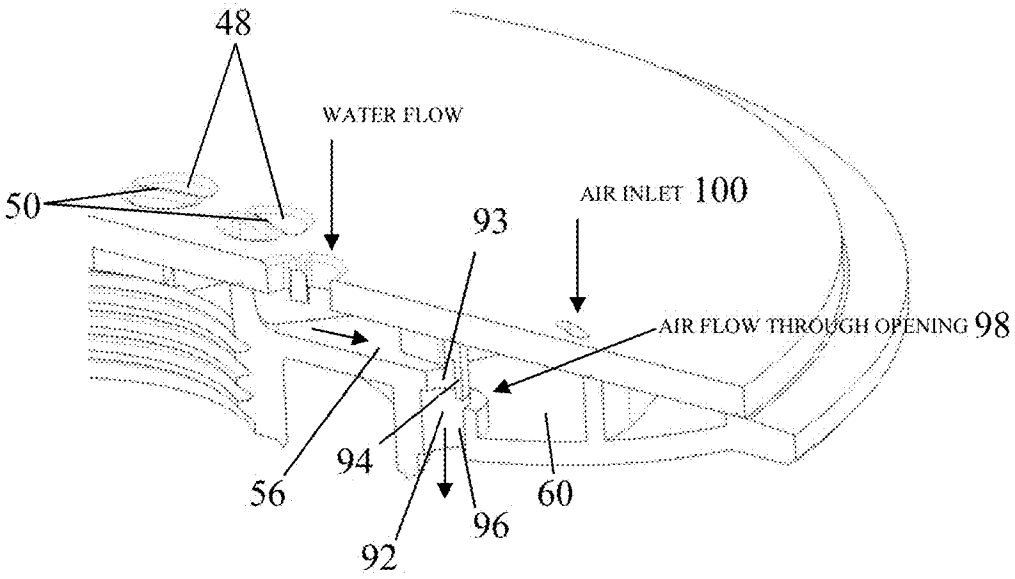
FIG. 7 is a partial cross-sectional view of a portion of the distributor shown in FIGS. 4-6.

FIG. 7 is a cross-section of the distributor 42 illustrating the aerated spray inlet 56 and aerated spray passage 92. The aerated spray inlet 56 leads to a passage 93 having a first cylindrical wall 94 with a first diameter. The first cylindrical wall 94 is positioned adjacent to a second cylindrical wall 96 with a second diameter larger than the first diameter. The first cylindrical wall 94 includes an air opening 98, and air enters the distributor 42 through an air inlet 100 and into an air chamber 60. Then, the air is drawn into the aerated spray passage 92 through the air opening 98 by way of a venturi effect created by the increase in diameter of the second cylindrical wall 96. Thus, air mixes with the fluid in the aerated spray passage 92, and the slot shape of air inlet 100 attenuates noise. In the illustrated construction, the air inlet 100 for the aerated spray mode is provided on the spray engine 12. Air flow only enters the aerated spray mode and is not activated with other spray modes.

Figure 8A:
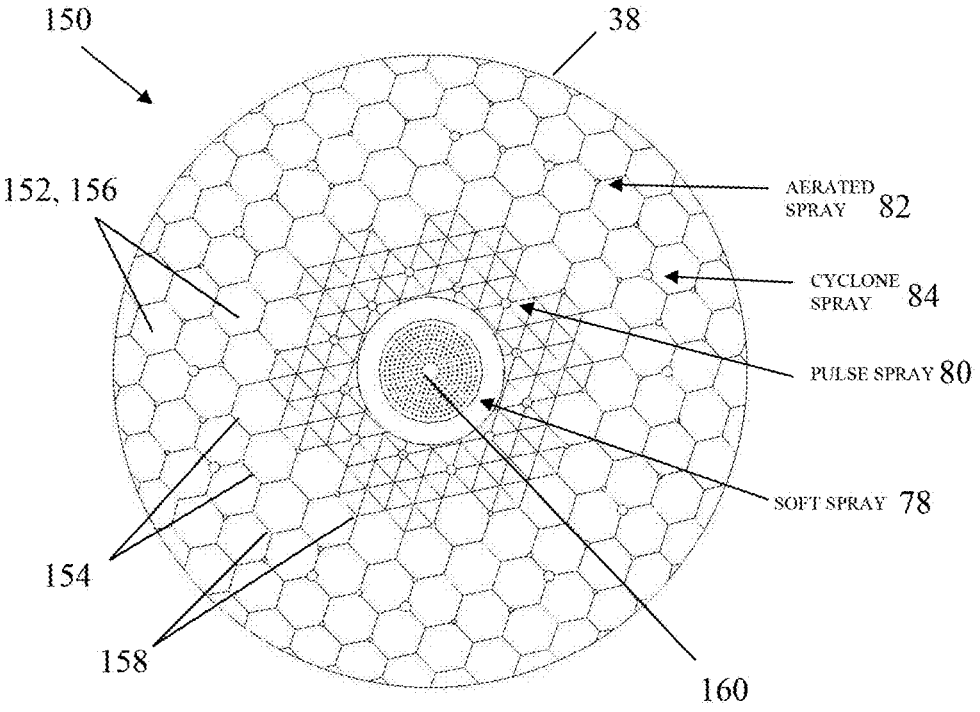
FIG. 8A is a front view of a spray face shown in FIGS. 1-4.
Figure 8B:
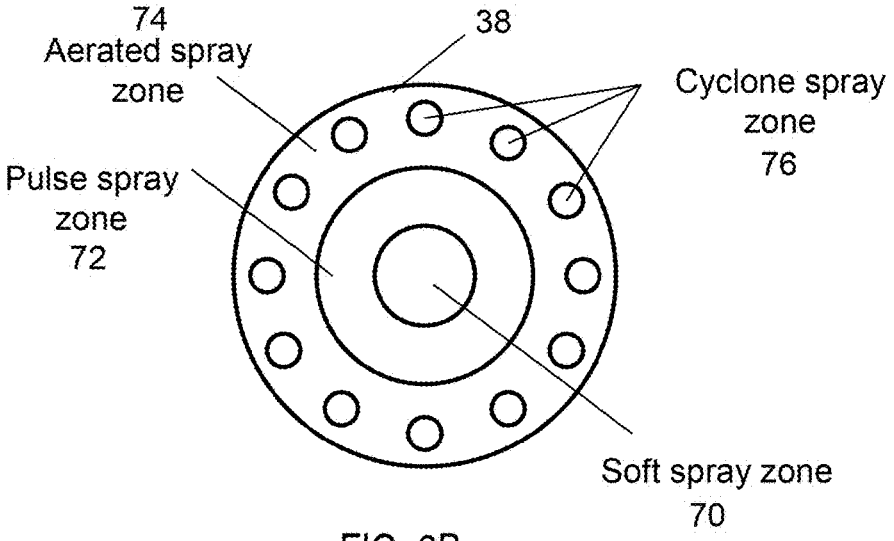
FIG. 8B is a schematic diagram of the spray face shown in FIG. 8A.

FIG. 8A is a front view of the spray face 38. As illustrated in FIGS. 8A and 8B, the spray face 38 may be divided into a plurality of spray zones including, for example, a soft spray zone 70, a pulse spray zone 72, an aerated spray zone 74, and a cyclone spray zone 76.

The soft spray zone 70 is substantially centrally located and positioned concentrically inside the pulse spray zone 72 and the aerated spray zone 74. The soft spray zone 70 includes a plurality of soft spray nozzles 78, and the soft spray nozzles 78 include a plurality of small openings through a thin metal substrate of the soft spray member 26.

The pulse spray zone 72 is positioned concentrically inside the aerated spray zone 74 and is generally an annular area. The pulse spray zone 72 includes a plurality of pulse spray nozzles 80.

The aerated spray zone 74 includes a plurality of aerated spray nozzles 82. The aerated spray zone 74 is generally an annular area positioned adjacent the outermost circumference of the spray face 38.

The cyclone spray zone 76 includes a plurality of cyclone spray nozzles 84. The cyclone spray zone 76 includes a plurality of discrete zones, each located inside the annular area of the aerated spray zone 74. Each cyclone spray zone 76 is completely surrounded by the aerated spray zone 74, as will be explained in greater detail below. In the illustrated construction, each discrete portion of the cyclone spray zone 76 includes one cyclone spray nozzle 84; however, in other constructions more than one nozzle 84 may be employed within each discrete portion of the cyclone spray zone 76.

The illustrated construction makes it possible to arrange one spray mode (e.g., the cyclone spray mode) inside another spray mode (e.g., the aerated spray mode) on the spray face 38 rather than in adjacent and separate areas of the spray face 38. Because multiple spray modes (e.g., the cyclone spray mode and the aerated spray mode) are provided at the same radial distance from the center of the spray face 38, the size of the spray engine 12 may be reduced (because the spray modes do not have to be provided at discrete radial distances, in separate annular rings).

Figure 9:
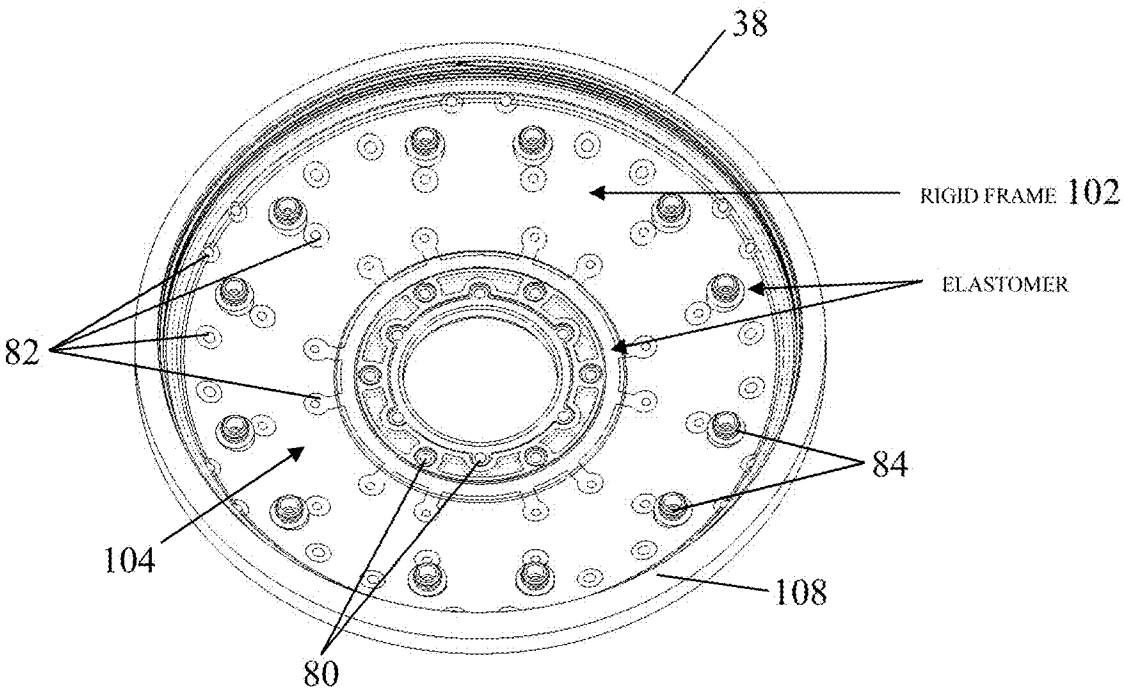
FIG. 9 is a rear perspective view of the spray face shown in FIG. 8A.

FIG. 9 is a rear view of the spray face 38. The spray face 38 is formed of a rigid frame 102 coated on the front face and sides by a coating or an elastomeric layer 108 (see also FIG. 10), such as a clear elastomer, a silicone elastomer, etc. The spray nozzles 78, 80, 82, 84 are concealed by an encapsulation method but are still fully elastomeric for easy cleaning of mineral deposits.

The two-piece spray face 38 (formed of frame 102 and elastomeric layer 108) may provide for a modular, modifiable design for the spray engine 12. The frame 102 may be common to multiple designs, while the covering layer 108 may be changed (e.g., surface pattern 150, color, graphics, spray modes (certain nozzles 80, 82, 84 provided or not), etc.).

The material of the elastomeric layer 108 extends into openings in the frame 102 (e.g., openings 109 corresponding to spray nozzles 80, 82 and/or 84). In at least some cases, the material extends through the openings 109 and is provided on and connected to the interior, or rear side, of the spray face 38 and provides integrated sealing features (e.g., one or more face seals 110*a*, radial seals 110*b* (see FIG. 10), lip seals, etc.) for sealing off spaces that lie between the distributor 42 and spray face 38. Separate face seal members 111 seal and separate the aerated spray zone 74 from the pulse spray zone 72.

The sealing features (e.g. the face seals 110*a* and the radial seals 110*b*) formed on the cyclone spray nozzles 84 seal and separate the cyclone spray zone 76 from the aerated spray zone 74. Water pressure through the cyclone spray nozzles 84 activates the radial seals 110*b* (e.g., pushes the material against the radial wall of the spray passages 66) to seal the higher pressure in the cyclone spray mode. In the aerated spray mode, with a lower water pressure, the face seals 110*a* provide sufficient sealing.

With continued reference to FIG. 9, the spray face 38 also includes the cyclone spray nozzles 84, which are formed of the elastomeric material 108 and mate with the cyclone spray passages 66 (see FIG. 6). Engagement of the cyclone spray nozzles 84 and passages 66 (see FIG. 10) locate and orient the spray face 38 relative to the distributor 42.

The cyclone spray nozzles 84 extend axially through an aerated spray plenum 104 and are completely surrounded circumferentially by the aerated spray plenum 104, and therefore by the aerated spray zone 74. The aerated spray plenum 104 is a space sandwiched between the front face of the distributor 42 and the internal face of the spray face 38. In the aerated spray zone 74, the aerated fluid flows from the aerated spray passages 92 in the distributor 42, into the aerated spray plenum 104, and exits the spray engine 12 through the aerated spray nozzles 82.

Figure 10:
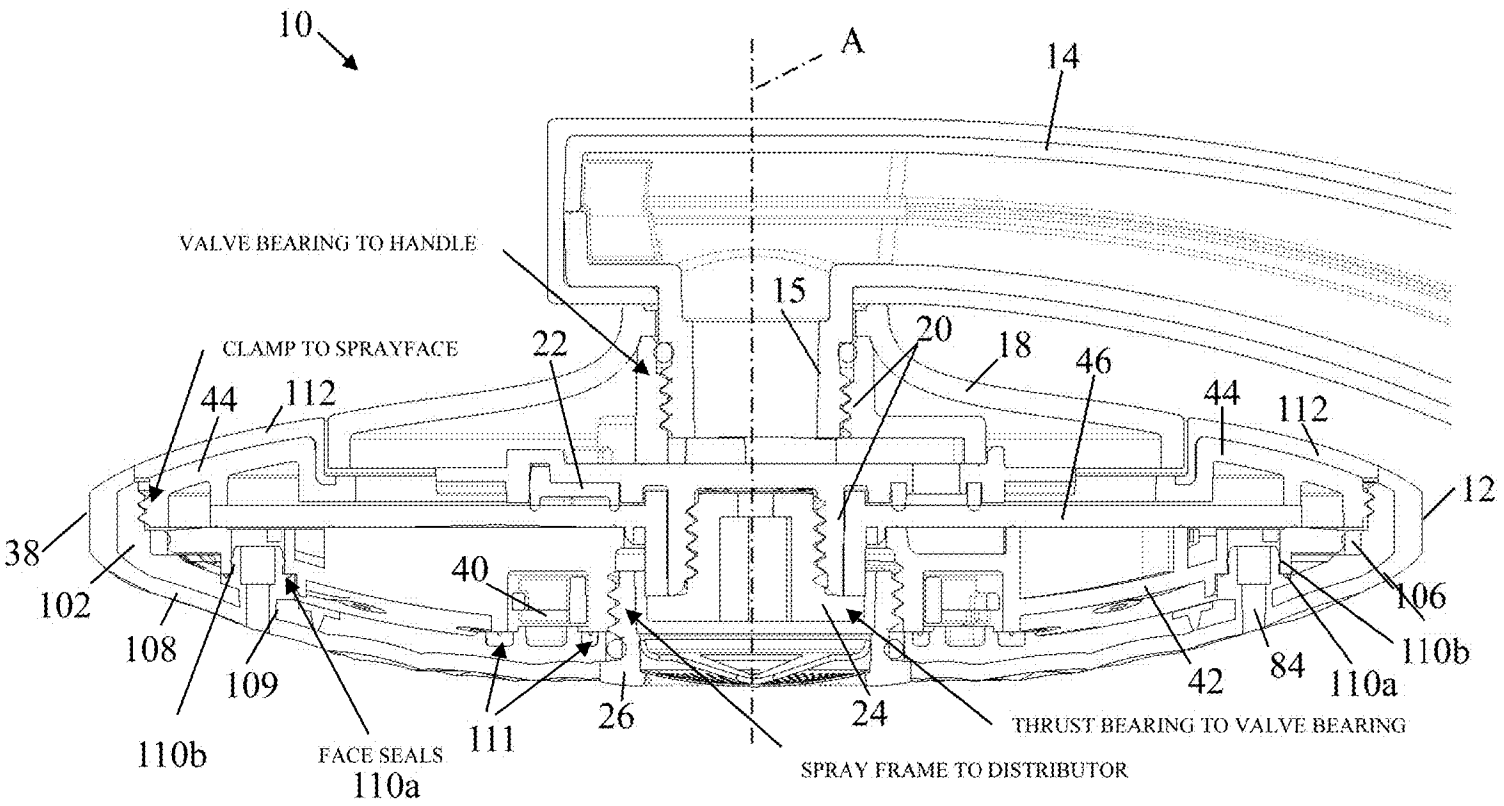
FIG. 10 is a cross-sectional view of the shower device shown in FIG. 1.
Figure 12:
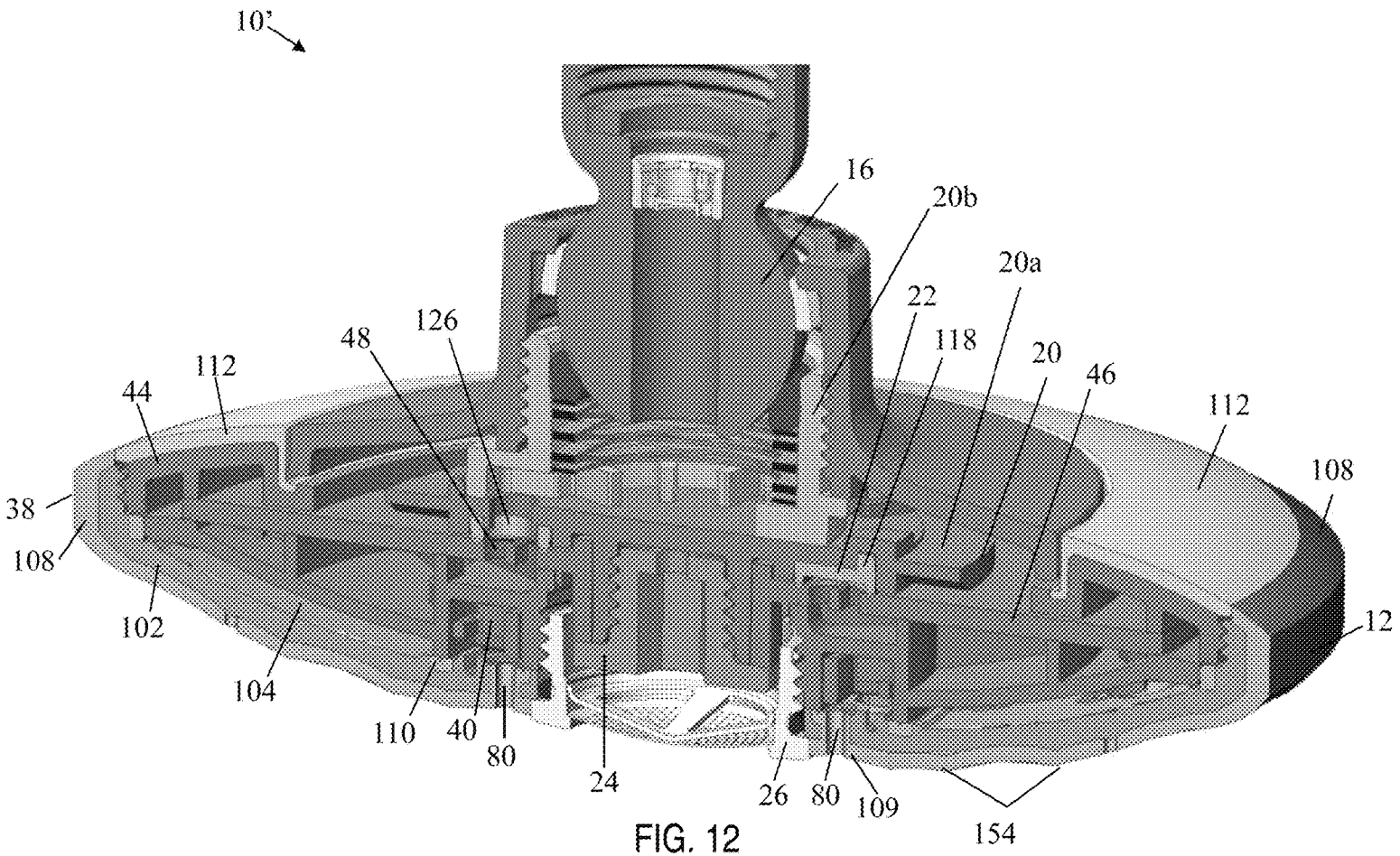
FIG. 12 is a cross-section of the shower device shown in FIG. 2.

Assembly of the components of the shower device 10, 10", 10' is illustrated in FIGS. 10-12, respectively. As shown in FIGS. 10-12, the soft spray member 26 is threaded to the distributor 42. The distributor 42 is disposed inside the spray face 38 and is sealed at the perimeter by a radial seal 106. The spray face 38 and the clamp 44 are threaded together and sandwich the distributor 42 therebetween to retain the distributor 42 against water pressure. The valve bearing 20 is coupled (e.g., threaded or sonically welded) to the structure of the shower device 10, 10", 10' (the handle 14, 14", the ball swivel 18). The entire assembly of the spray engine 12 is held against the valve bearing 20 by the thrust bearing 24, which is threadedly connected to an inner wall of the valve bearing 20.

As described above, the front face and sides of the spray face 38 are coated with an elastomeric layer 108, i.e., the elastomeric layer 108 coats surfaces of the spray face 38 that are outer surfaces of the spray face 38 when the shower device 10, 10", 10' is assembled. The outer surface of the clamp 44 is also coated with an elastomeric layer 112. In the final assembly of the shower device 10, 10", 10', the elastomeric layers 108, 112 abut to form a continuous elastomeric coating that covers the front, sides and at least a portion of the rear of the shower device 10, 10", 10' (see FIGS. 11 and 12). The elastomeric layer(s) 108 and/or 112 provide a frictional surface to rotate the spray engine 12 between the various shower modes (e.g., by hand or other body part, against a wall of the shower enclosure, etc.).

FIG. 13 is a partial cross-section of the valve bearing 20. The valve bearing 20 is a single piece structure that cooperates with the handle 14, 14" or ball swivel 16 and provides the main bearing for the spray engine 12. For example, in the illustrated construction, the valve bearing 20 is formed by connecting two pieces together, a first piece 20*a* and a second piece 20*b* (e.g., by welding, sonic welding, adhesive, etc.). The first piece 20*a* is a common piece including a recess 114 for receiving the valve 22 (see FIG. 14), and the second piece 20*b* is an adapter for providing an interface with the respective type of shower device 10, 10', 10", e.g., a female thread for the handle 14 (see FIG. 10), a male thread for the housing 20 (see FIG. 12, shower device 10') or a non-threaded connection such as sonic welding for the handle 14" (see FIG. 11). The valve bearing 20 includes a recess 114 for receiving the valve 22 (see FIG. 14), and the valve 22 is fixed against rotation relative to the valve bearing 20 by inter-engaging valve keys 116 (FIG. 13) and rotational keys 118 (FIG. 14).

Fluid enters the valve bearing 20 from the handle 14, 14" (or ball swivel 16) through an inlet 120. Fluid then passes through a water passage 122 to each of three apertures 124. The apertures 124 are aligned with three corresponding water flow ports 126 in the valve 22 (FIG. 14). Fluid flows through the ports 126 to the spray engine 12.

Figure 14:
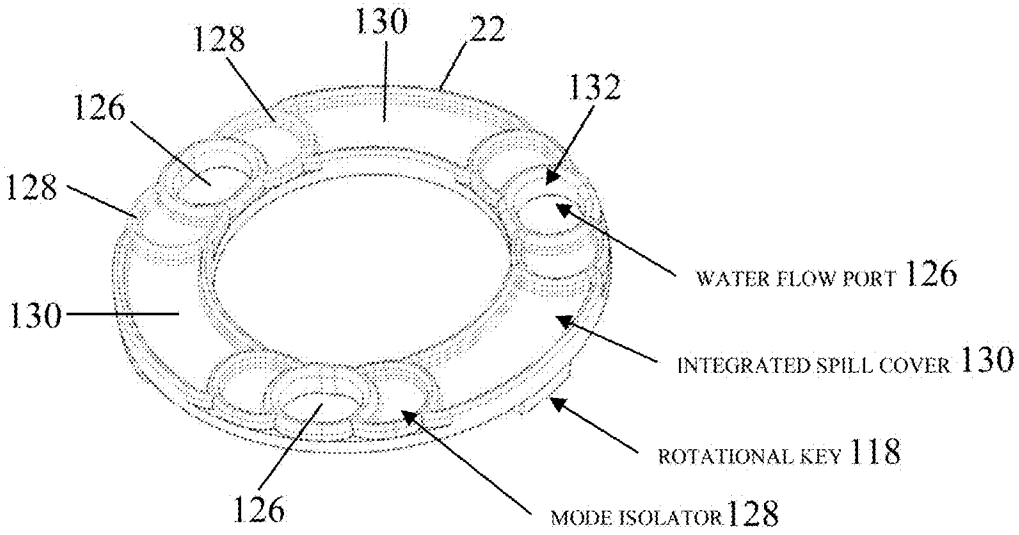
FIG. 14 is a perspective view of a valve shown in FIG. 3.

As shown in FIG. 14, the valve 22 includes a valve body defining the flow ports 126 for communicating the fluid from a fixed portion of the shower device 10 to a rotatable portion of the shower device 10. In the illustrated construction, the fixed portion of the shower device 10 includes the handle 14, 14" (or ball swivel 16), the escutcheon 18, the valve bearing 20, the valve 22, and the thrust bearing 24, and the rotatable portion of the shower device 10 includes the spray engine 12.

Figure 15:
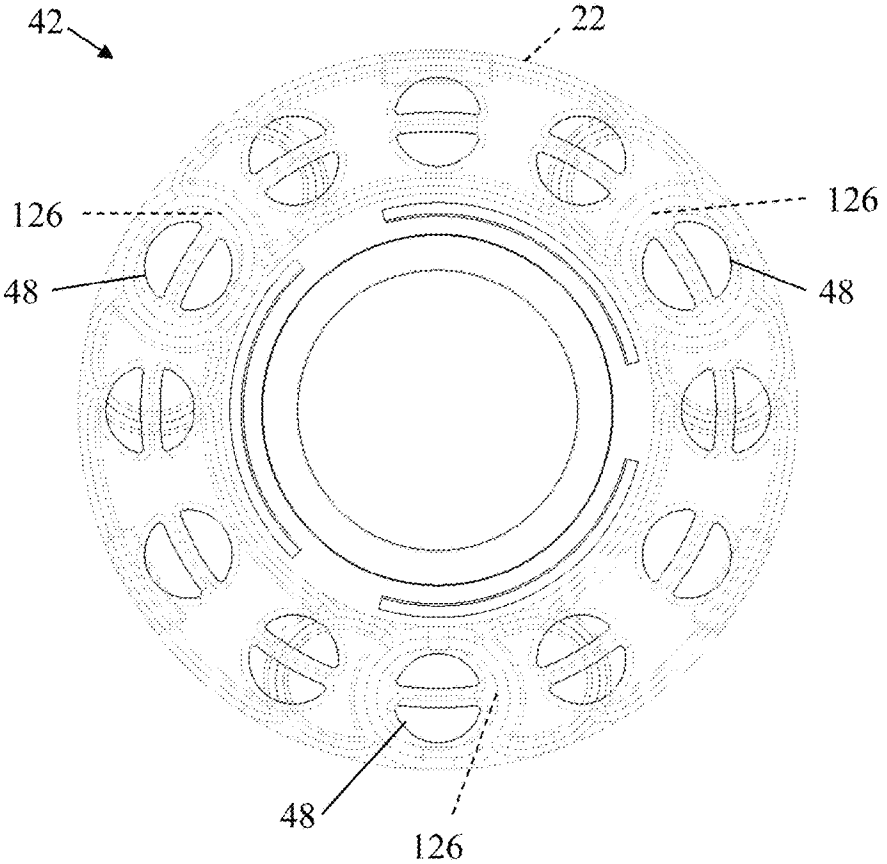
FIG. 15 is a bottom view of the distributor positioned fully in mode with respect to the valve.

In a given position of the spray engine 12 with respect to the valve 22 (see FIG. 15), a set of three associated ports 48, each spaced 120 degrees apart, aligns with the three flow ports 126 in the valve 22. FIG. 15 illustrates the ports 48 in one of the twelve discrete rotational positions of the spray engine 12 (e.g., fully in a spray mode).

As described above, each set of three ports 48 corresponds with a set of spray inlets 52, 54, 56, 58 corresponding with a single spray mode. The illustrated spray engine 12 provides four spray modes, and, with twelve ports 48 and twelve discrete rotational positions spaced apart by 30 degrees, the spray engine 12 advances sequentially through each of the four spray modes three times within a single 360 degree revolution.

In other constructions, a different number spray modes and ports 48 may be employed, as desired. For example, the shower device 10 may include one, two, three, four, five or more modes, and be scaled to various sizes (e.g., from 90 mm to 160 mm diameter). Any combination of number of modes and size may be employed.

The valve 22 also includes mode isolators 128 flanking each flow port 126 and integrated spill covers 130 between adjacent mode isolators 128. The valve 20 is formed as a single integral unit, and the ports 126, the mode isolators 128 and the integrated spill covers 130 are defined and separated by a raised sealing surface 132. The raised sealing surface 132 engages the distributor 42 and slides with respect to the distributor 42 to form a face seal. The raised sealing surface 132 is thickest around each port 126 for sealing against a higher pressure, and thinner around the mode isolators 128 for lower pressure spill protection.

In the illustrated construction, the valve 22 is formed of silicone. In other constructions, the valve 22 may be formed of other materials, such as, for example, EPDM and related rubber compounds, thermoplastic elastomers, etc.

The valve 22 is symmetric so that the compression load is uniformly distributed. The material for the valve 22 has low compression set and can therefore maintain sealing pressure without the use of a spring. The raised sealing surface 132 is located close to the center of rotation, reducing resistance to rotation caused by seal friction.

Figure 16:
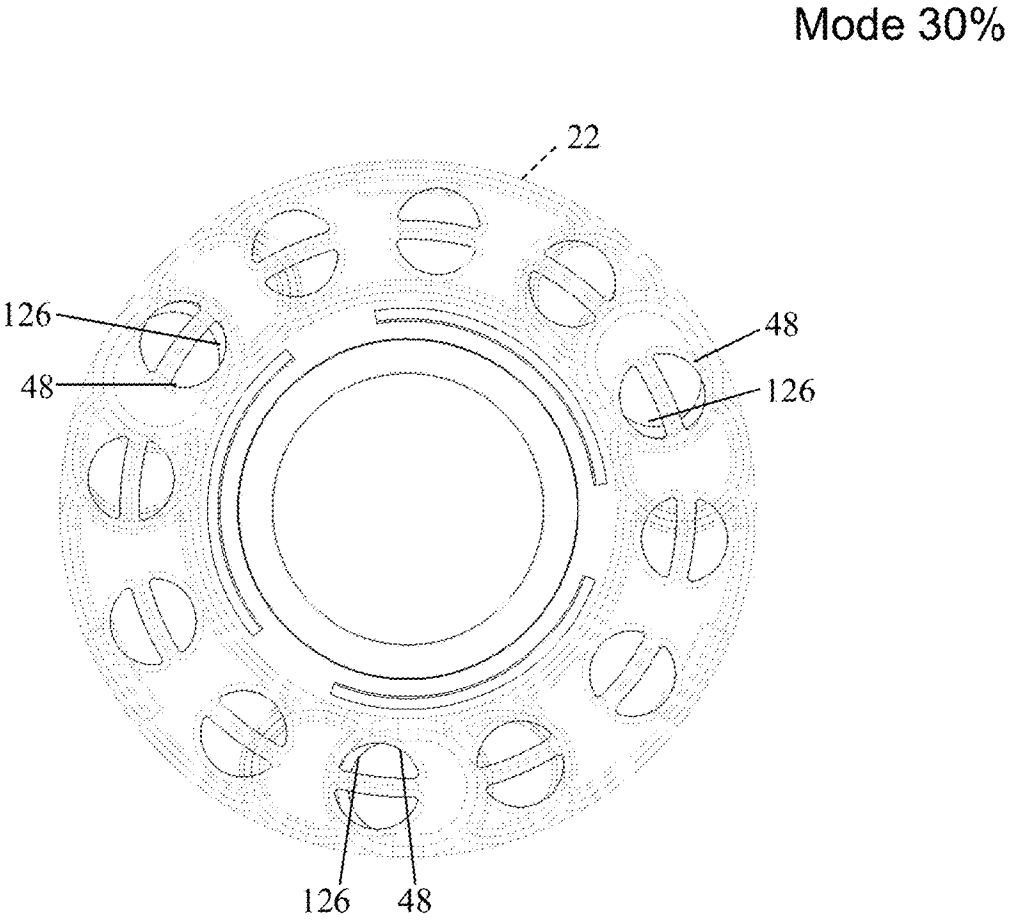
FIG. 16 is a bottom view of the distributor positioned 30% out of mode with respect to the valve.
Figure 17:
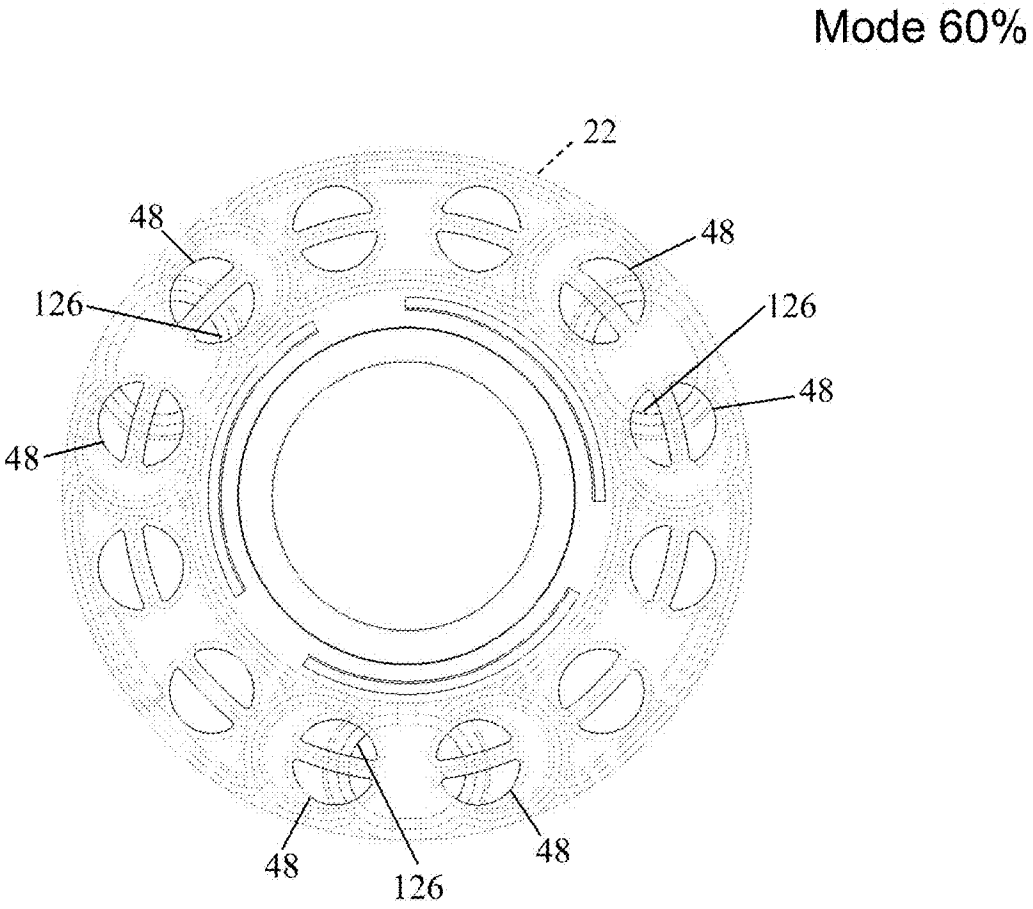
FIG. 17 is a bottom view of the distributor positioned 60% out of mode with respect to the valve.
Figure 18:
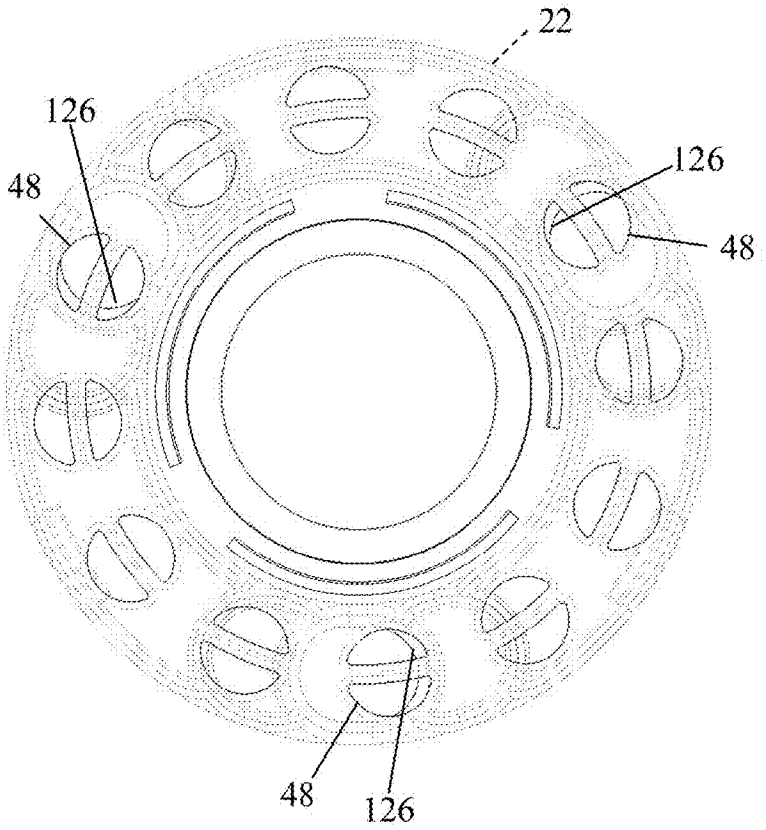
FIG. 18 is a bottom view of the distributor positioned 90% out of mode with respect to the valve.

FIGS. 16-18 illustrate the ports 48 of the spray engine during a mode change between adjacent discrete positions, i.e., transitioning between a first discrete position (and first spray mode) in which one set of ports 48 is aligned with the (three) water flow ports 126 and an adjacent second discrete position (and adjacent second spray mode) in which the adjacent set of ports 48 is aligned with the water flow ports 126. During the transition, each of the one set of ports 48 moves out of alignment with the associated water flow port 126, and each of the adjacent set of ports 48 moves into alignment with the associated water flow port 126.

In FIG. 16, the spray engine 12 has been rotated about 30% of the way (e.g., about 9 degrees) from one discrete position (and first spray mode) to the adjacent discrete position (and adjacent second spray mode). In FIG. 17, the spray engine 12 has been rotated about 60% of the way (e.g., about 18 degrees) from the one discrete position to the adjacent discrete position. In FIG. 18, the spray engine 12 has been rotated about 90% of the way (e.g., about 27 degrees) from the one discrete position to the adjacent discrete position.

When the spray engine 12 is fully in a position, all (three) water flow ports 126 deliver fluid for the selected one spray mode of the spray engine 12. The flow ports 126 for the other spray modes are "capped" by the valve 22 (e.g., by the mode isolators 128 and/or the integrated spill covers 130).

The illustrated multi-port arrangement may increase flow area while reducing the size of the valve 22. Low pressure performance may also be improved. In addition, the construction may provide more uniform water distribution, important for an aerated spray mode.

During the transition mode, two adjacent modes receive a flow of fluid simultaneously (see, e.g., FIG. 17) and are therefore fluidly connected during the transition mode. Fluid flow to the first spray mode decreases as fluid flow to the adjacent second mode simultaneously increases. Fluid flow is not shut off during the transition.

Without the mode isolator 128, all four modes would be fluidly connected during mode change and would all discharge water in between modes. The mode isolators 128 effectively isolate two adjacent spray modes during mode change to create a smooth transition from one mode to the next. Furthermore, the valve 22 (the integrated spill covers 130) covers the ports 48 which are not in use to prevent fluid from draining from the spray passages which are not in use.

In operation, a user engages (e.g., grips, presses against a surface) the elastomeric layer(s) 108, 112 to rotate the entire spray engine 12 between different modes. The elastomeric layer 108, 112 increases friction between the spray engine 12 and a wet environment, such as a hand or any other available surface. For example, a user may grip the outer circumference of the spray engine 12 to turn the spray engine 12. With the hand shower construction (shower device 10, 10"), a user may grip the handle 14 and push the spray engine 12 against the shower wall to rotate the spray engine 12 to the next mode (e.g., a "pizza cutter" motion).

The illustrated spray engine 12 repeats the spray modes (soft spray, pulse spray, aerated spray and cyclone spray) three times in a full 360 degree rotation. A user can thus rotate in either direction to change the spray mode, and reversal of the direction of rotation is not required to select a desired spray mode. Rotation of the spray engine 12 is continuous in either direction. Each adjacent spray mode is separated by only 30 degrees of rotation of the spray engine 12 and the same spray mode is repeated every 120 degrees.

FIGS. 19-33 illustrate an alternative construction of a shower device 210. The shower device 210 is similar to the shower device 10, 10', 10" described above and illustrated in FIGS. 1-18. Common elements have the same reference number plus 200. It should be understood that alternative constructions of FIGS. 19-33 may be substituted with the corresponding structure illustrated in FIGS. 1-18.

Figure 19:
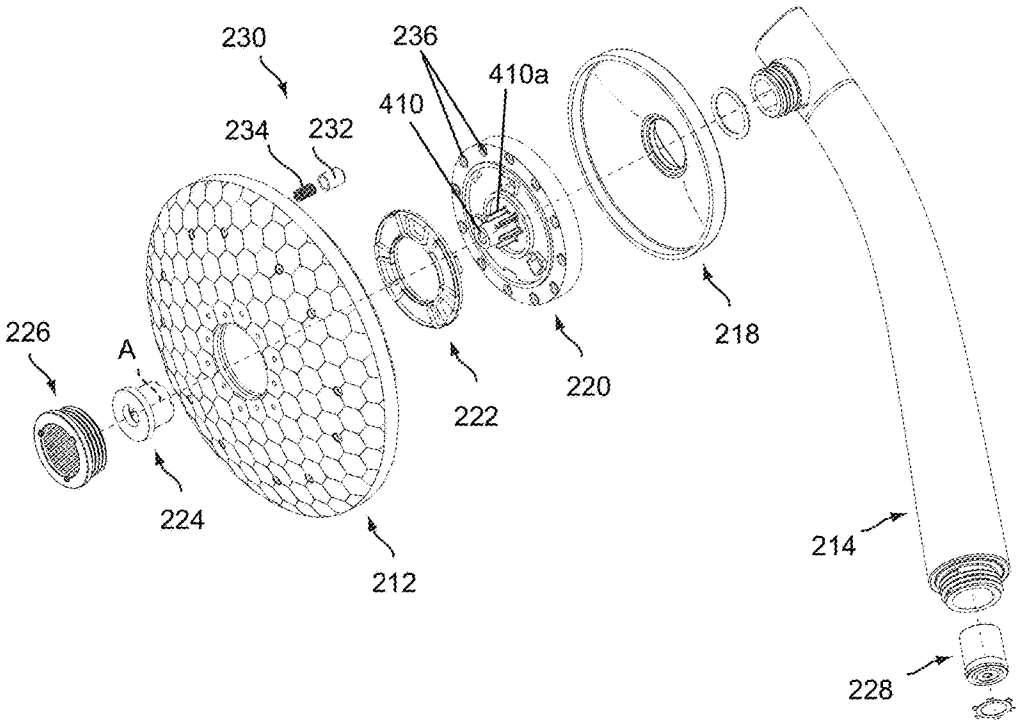
FIG. 19 is an exploded view of an alternative construction of a shower device, such as a hand shower.

As shown in FIG. 19, the illustrated shower device 210 includes a handle 214 and is a hand shower. In other constructions (not shown), the spray engine 212 may be coupled with other fluid supply mechanisms to form other types of shower devices, such as, for example, a shower head, a rain can, a wall-mounted water tile, etc.

FIGS. 19, 21, 23 and 28-33 illustrate an alternative construction of the flow ports 324, 326 and 248 in the valve bearing 220, the valve 222 and the distributor 242, respectively. In the illustrated construction, the ports 324, 326, 248 are substantially sector-shaped. Relative to round-shaped ports (e.g., the ports 124, 126, 48 (see FIGS. 5 and 13-14)), the sector shape increases the flow area by using substantially the entire area of a sector of a circle. This increased flow area, however, does not affect the timing of the mode changes. On the valve 222 (see FIGS. 19, 28-33), the mode isolators 328, flanking each flow port 326, and integrated spill covers 330, between adjacent mode isolators 328, are also substantially sector-shaped.

Figure 26:
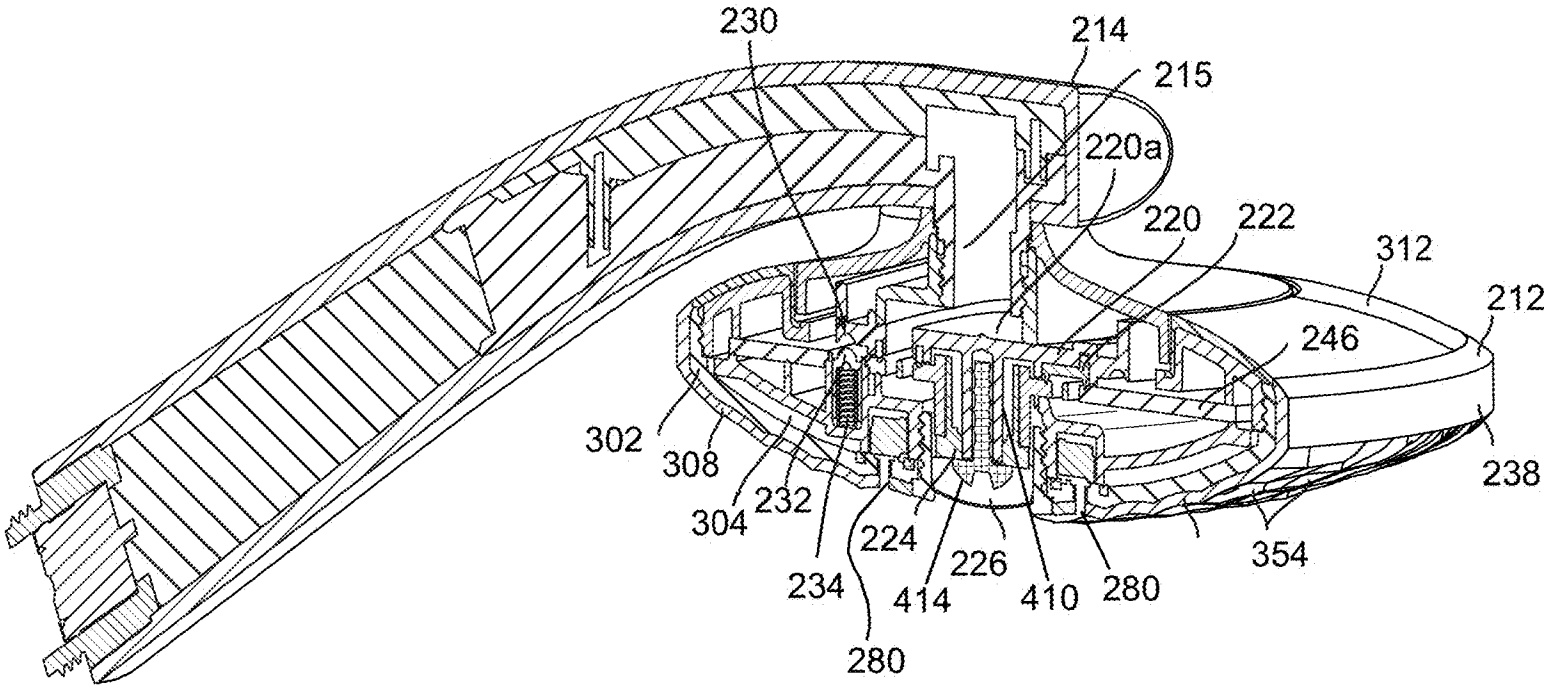
FIG. 26 is another cross-sectional view of the shower device shown in FIG. 25.
Figure 27:
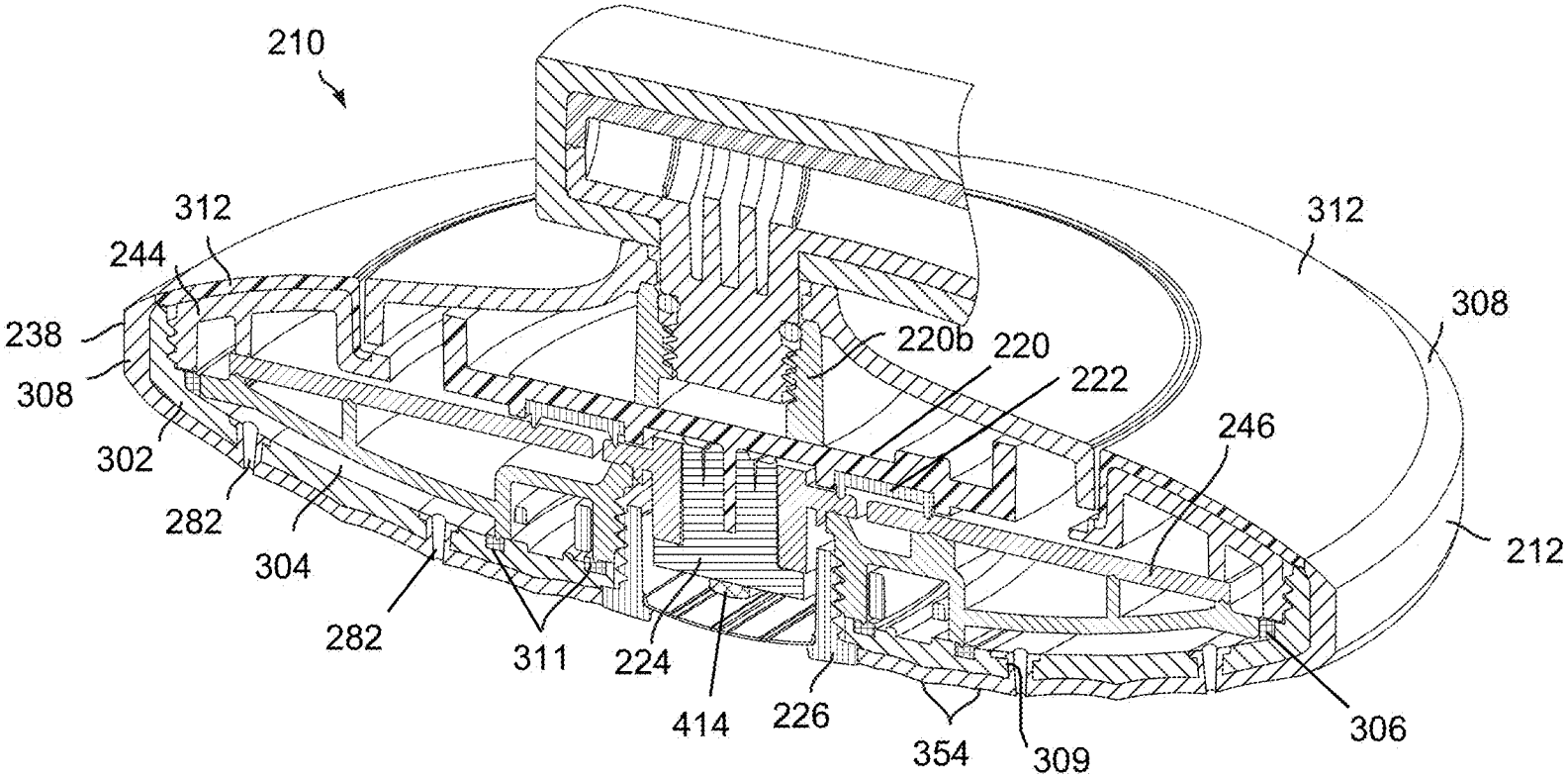
FIG. 27 is another cross-sectional view of the shower device shown in FIG. 25.
Figure 28:
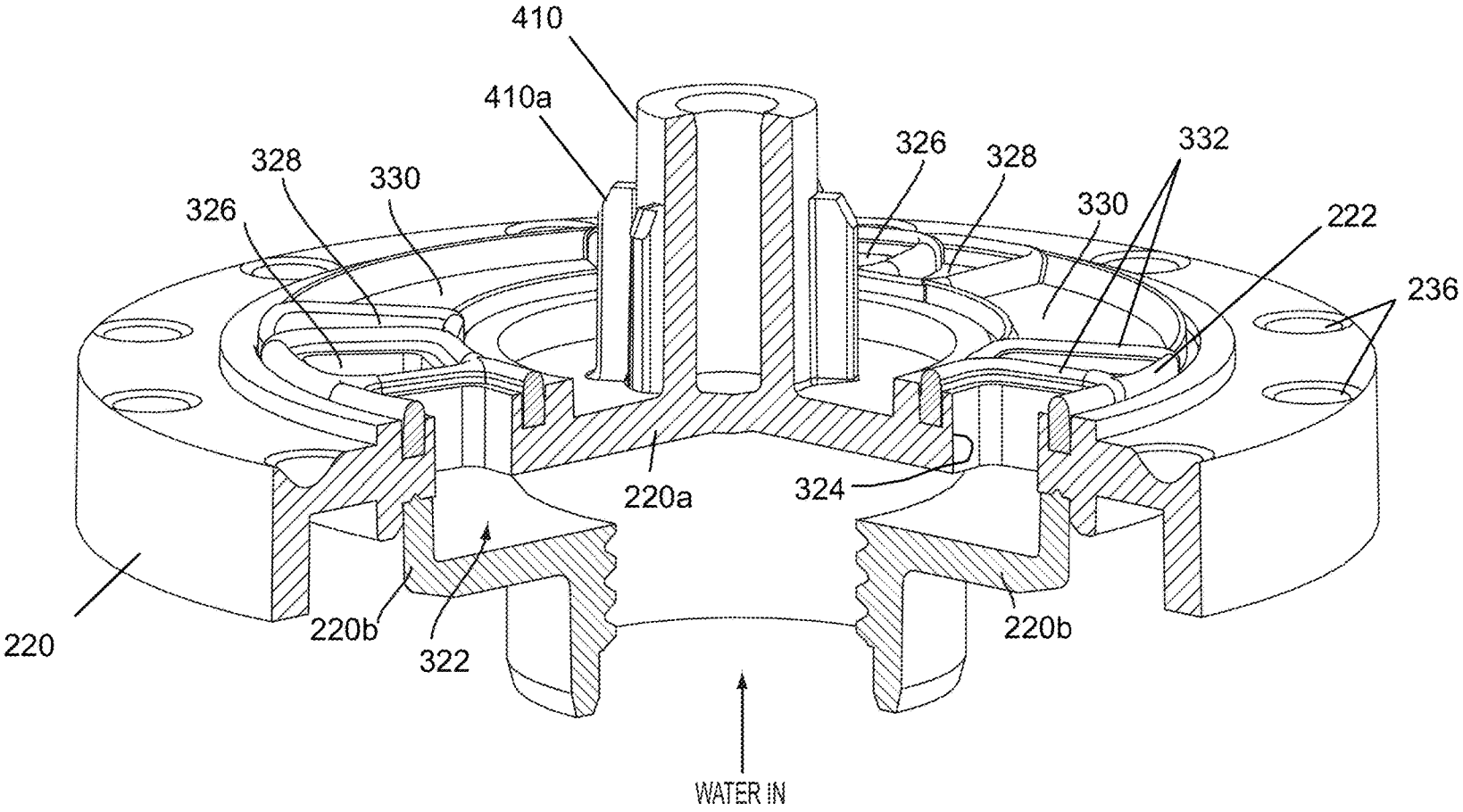
FIG. 28 is a perspective view of a valve bearing shown in FIG. 19, having a section cut out.
Figure 29:
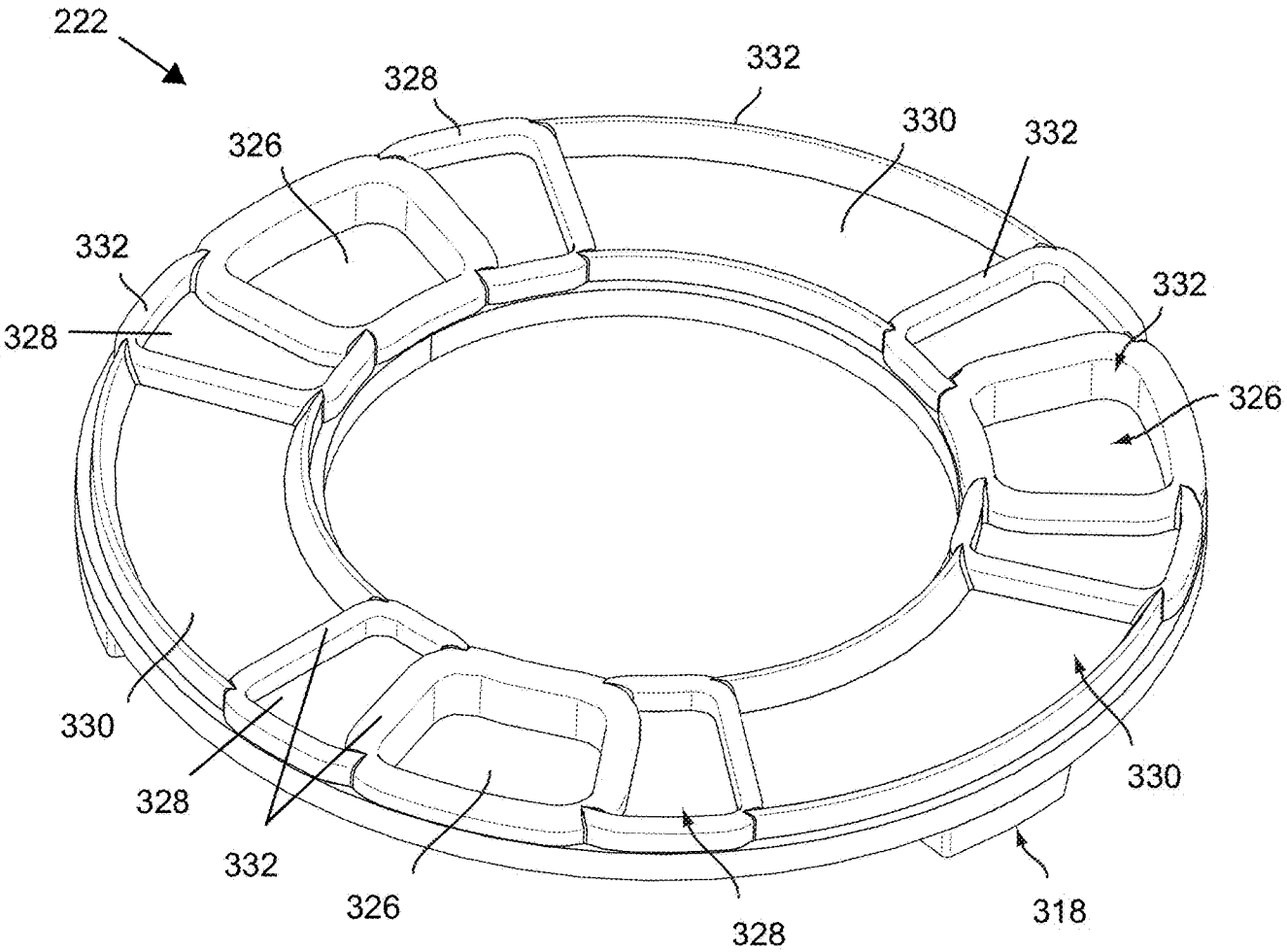
FIG. 29 is a perspective view of a valve shown in FIG. 19.
Figure 30:
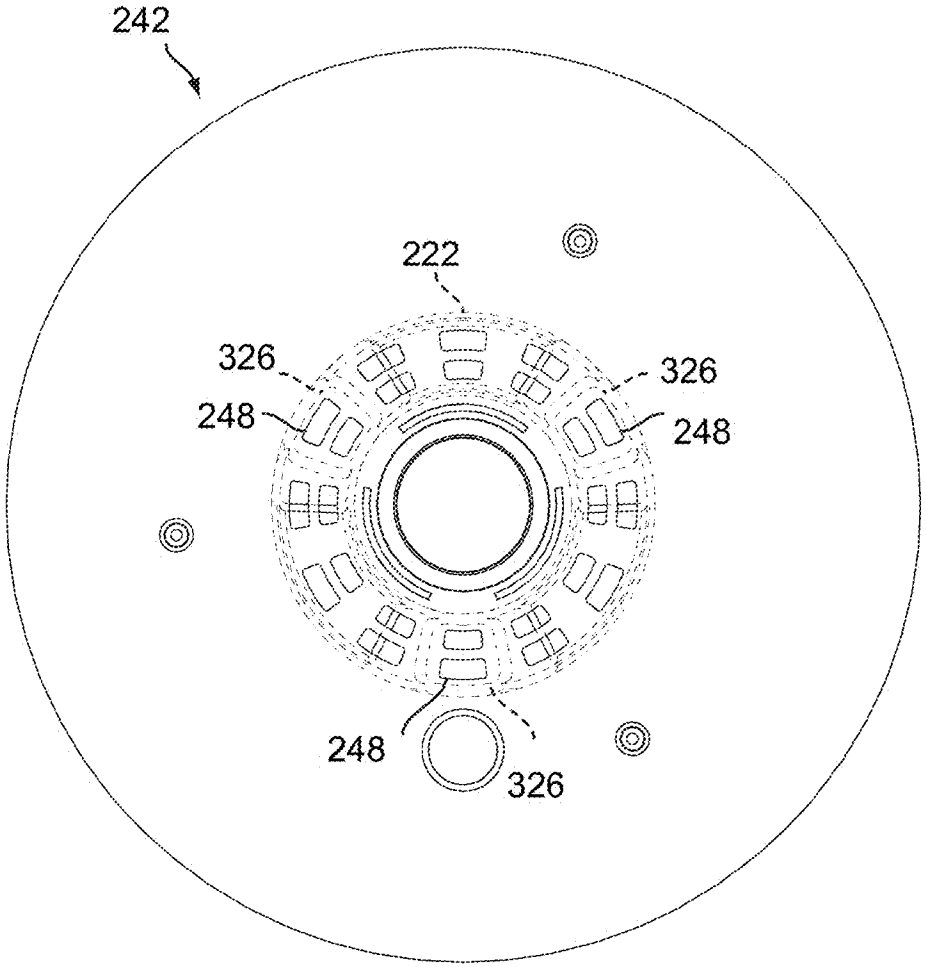
FIG. 30 is a bottom view of the distributor positioned fully in mode with respect to the valve.

As shown in FIGS. 19 and 26, in the illustrated detent mechanism 230, the detent grooves 236 have the shape of a portion of a sphere, generally corresponding to the shape of inter-engaging surface of the detent member 232. The shape of the grooves 236 may provide increased contact with the surface of the detent member 232, durability of the detent mechanism etc.

In the illustrated construction (see FIGS. 19 and 26-27), the thrust bearing 224 mates with a boss 410 on the valve bearing 220. The thrust bearing 224 and the boss 410 having inter-engaging ribs (see ribs 410*a* shown on the boss 410) to limit relative rotation. The entire assembly of the spray engine 212 is held against the valve bearing 220 by the thrust bearing 224, which is threadedly connected by a fastener 414 to the boss 410. In the illustrated construction, the running surfaces are provided on a single component, the thrust bearing 224, and are formed of the same material.

Figure 20:
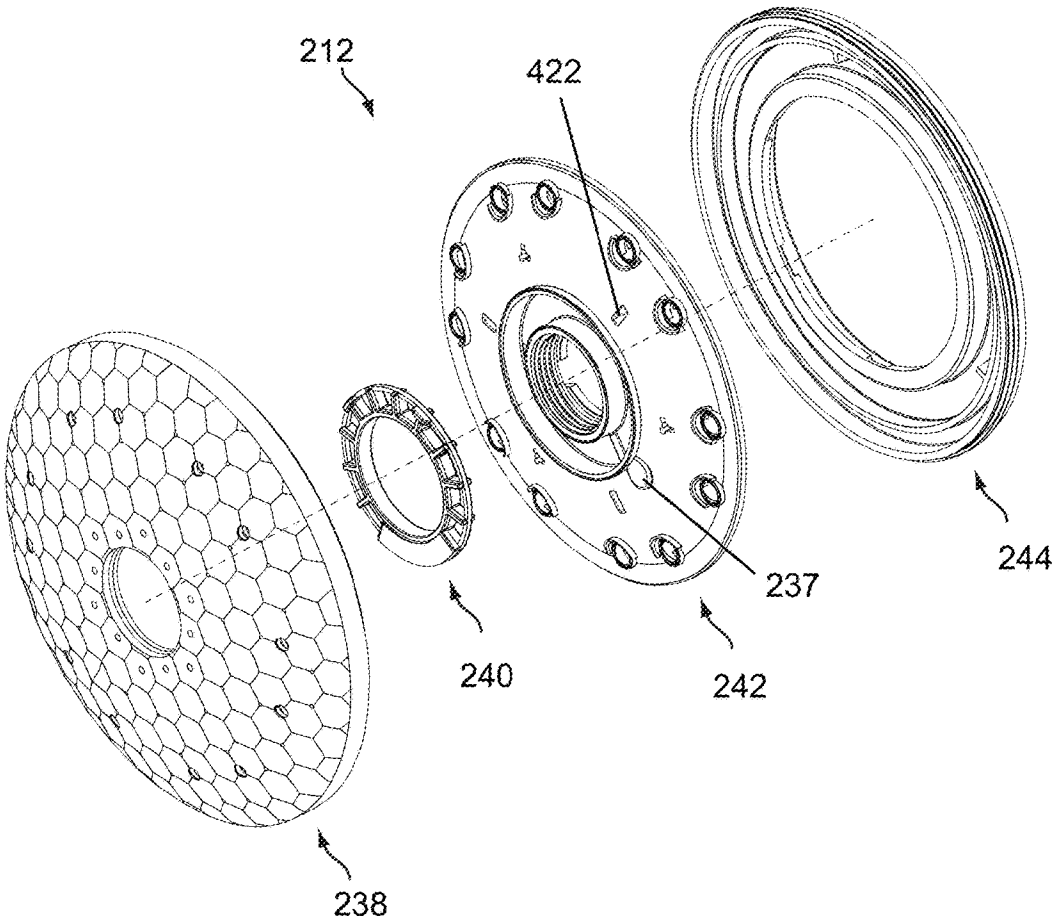
FIG. 20 is an exploded view of a spray engine shown in FIG. 19.
Figure 22:
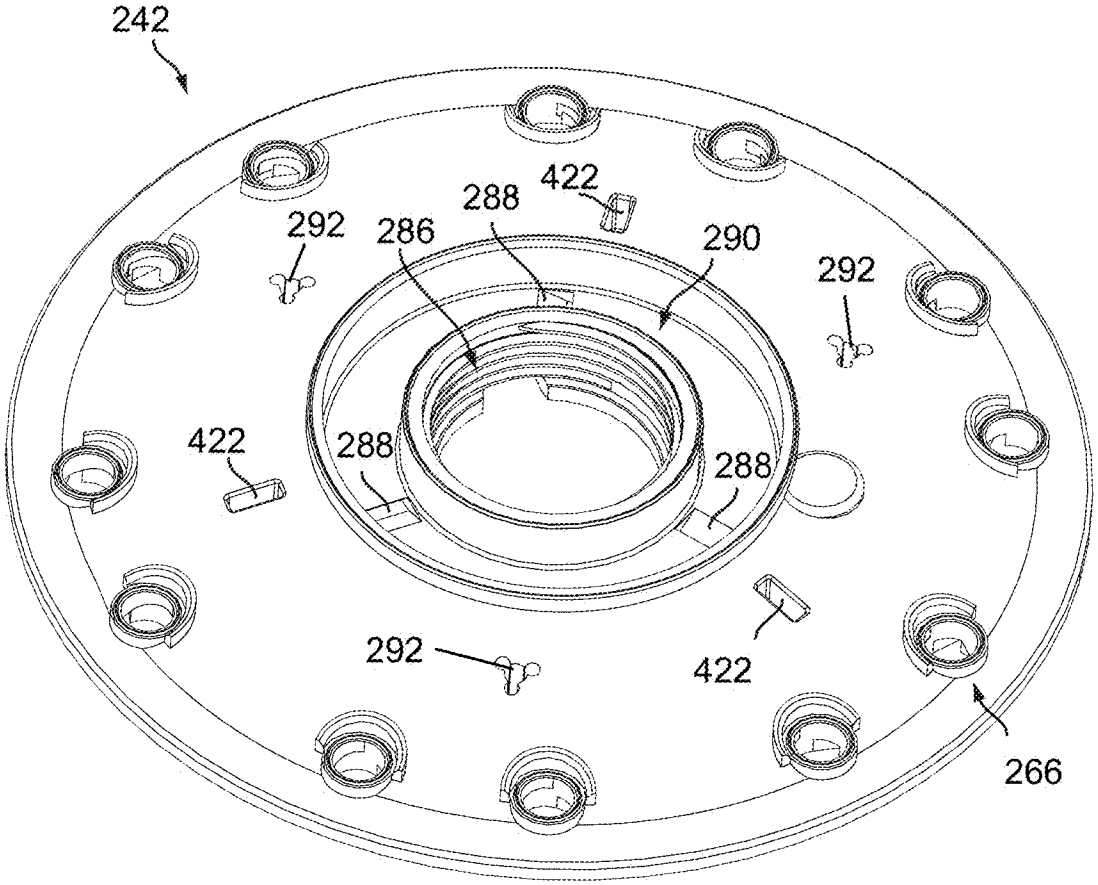
FIG. 22 is a front perspective view of the distributor shown in FIG. 20.
Figure 23:
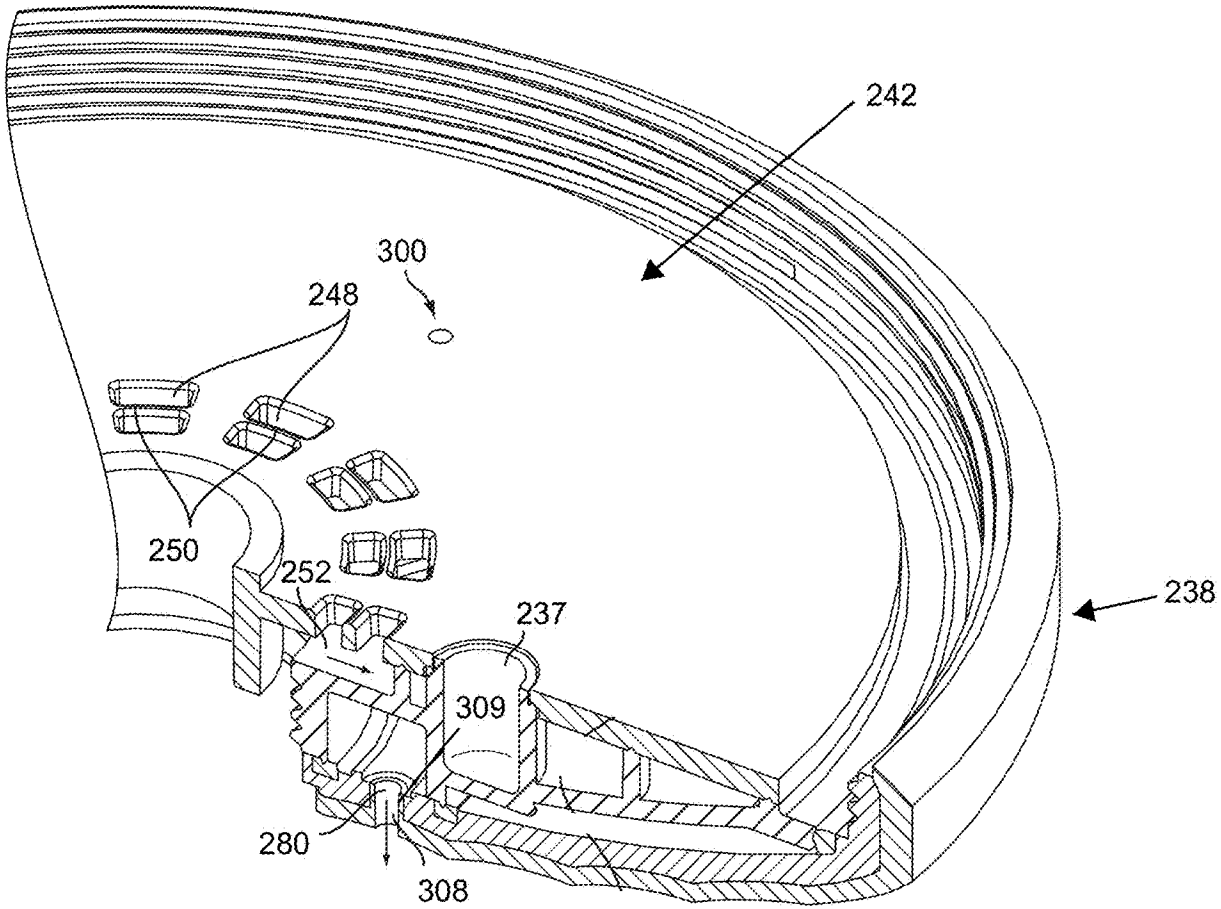
FIG. 23 is a partial cross-sectional view of a portion of the distributor shown in FIGS. 20-22.
Figure 24:
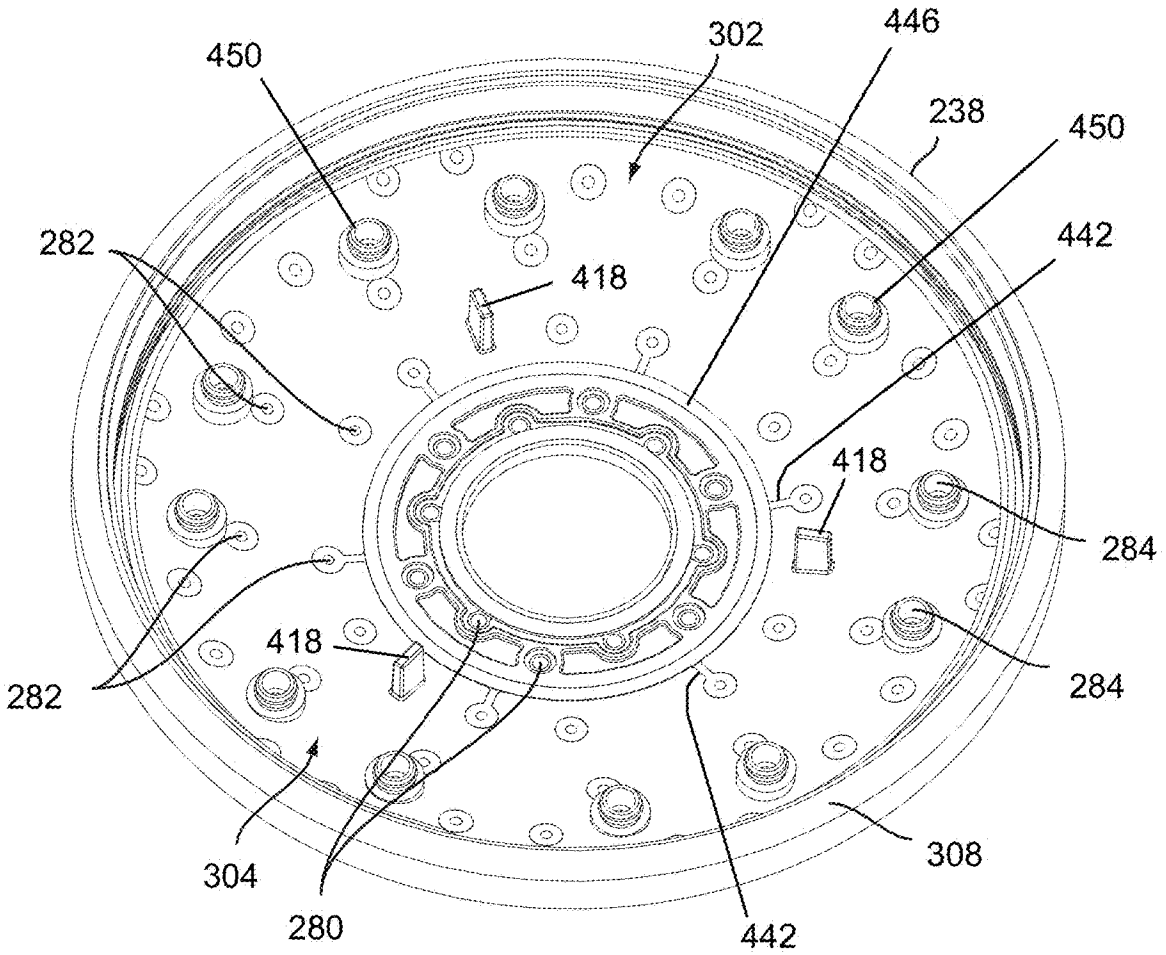
FIG. 24 is a rear perspective view of the spray face shown in FIG. 20.
Figure 25:
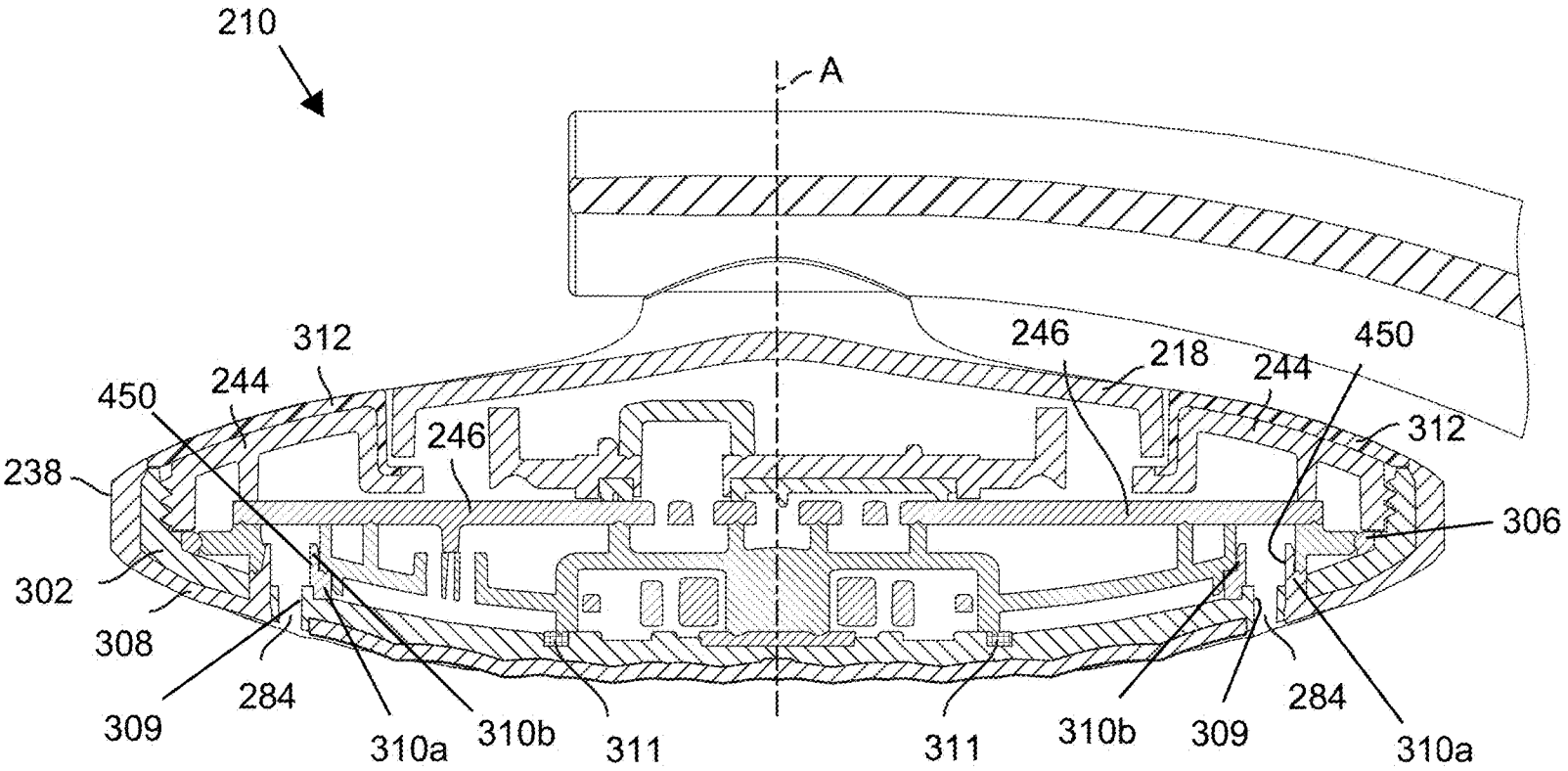
FIG. 25 is a cross-sectional view of the shower device shown of FIG. 19.

As shown in FIGS. 20, 22 and 24, features are provided between the spray face 238 and the distributor 242 to locate and orient the spray face 238 and the distributor 242. The illustrated locating features include the inter-engaging elastomeric cyclone spray nozzles 284 and the cyclone spray passages 266. Additionally or alternatively, in the illustrated construction, rigid keys 418 (shown in FIG. 24) and keyholes 422 (shown in FIGS. 20 and 22) are engageable to locate and orient the spray face 238 relative to the distributor 242.

In the illustrated construction, the spray engine 212 is symmetrical, and the locating features (e.g., the nozzles/passages 284/266 and/or the keys/keyholes 418/422, as provided) are symmetrical. In other constructions (not shown; e.g., with an asymmetrical spray engine), the locating features may be asymmetrical (different size, shape, location (radial and/or circumferential), etc.) to locate and orient the spray face and the distributor in a limited number of orientations (e.g., a single orientation).

Figure 21:
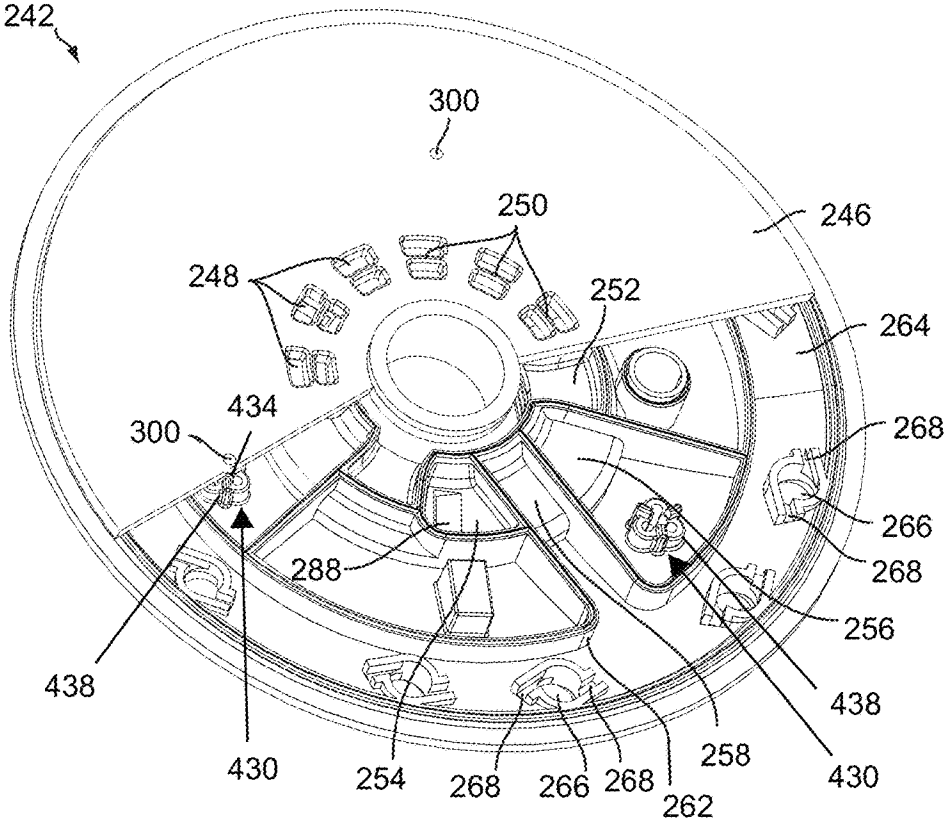
FIG. 21 is a rear perspective view of a distributor shown in FIG. 20, having about a one-third portion cut out to show the interior of the distributor.

As shown in FIGS. 20-22, the aerated spray inlet 256 leads to a cloverleaf-shaped aerated spray passage 430 projecting from the bottom wall. A tube 434 extends from the air inlet 300 and engages the planar surface of the passage 430. Ribs 438 locate the tube 434 on the passage 430. The tube 434 limits the flow of water into the outer portions of the cloverleaf shape (e.g., a vena contracta). Air mixes with the water in the aerated spray passage 430, and the shape of air inlet 300 attenuates noise. In the illustrated construction, the air inlet 300 for the aerated spray mode is provided on the spray engine 212. As with the spray engine 12, air flow only enters the aerated spray mode of the spray engine 212 and is not activated with other spray modes.

FIGS. 23-25 and 27 illustrate an alternative construction of portions of the elastomeric layer 308, the frame 302 and sealing features provided by the elastomeric material 308. Material of the elastomeric layer 308 extends into and through openings in the frame 302 (e.g., openings 309 corresponding to the pulse spray nozzles 280 (see FIG. 23) and to the aerated spray nozzles 282 (see FIG. 27). As shown in FIG. 24, material provided through these openings 309 is provided to the interior or rear side of the frame 302. Webs 442 of material extend from selected openings 309 to form features of elastomeric material at locations spaced from the openings 309 (e.g., annular member 446).

In the illustrated construction (see FIG. 25), material forming the cyclone passage 450 does not extend through the opening 309 corresponding to the cyclone spray nozzle 284. Instead (see FIG. 24), the passage 450 is formed of material extending through the opening 309 corresponding to selected aerated spray nozzles 282. The sealing features (e.g. the face seals 310*a* and the radial seals 310*b*) formed on the cyclone spray passage 450 seal and separate the cyclone spray zone 276 from the aerated spray zone 274.

Figure 31:
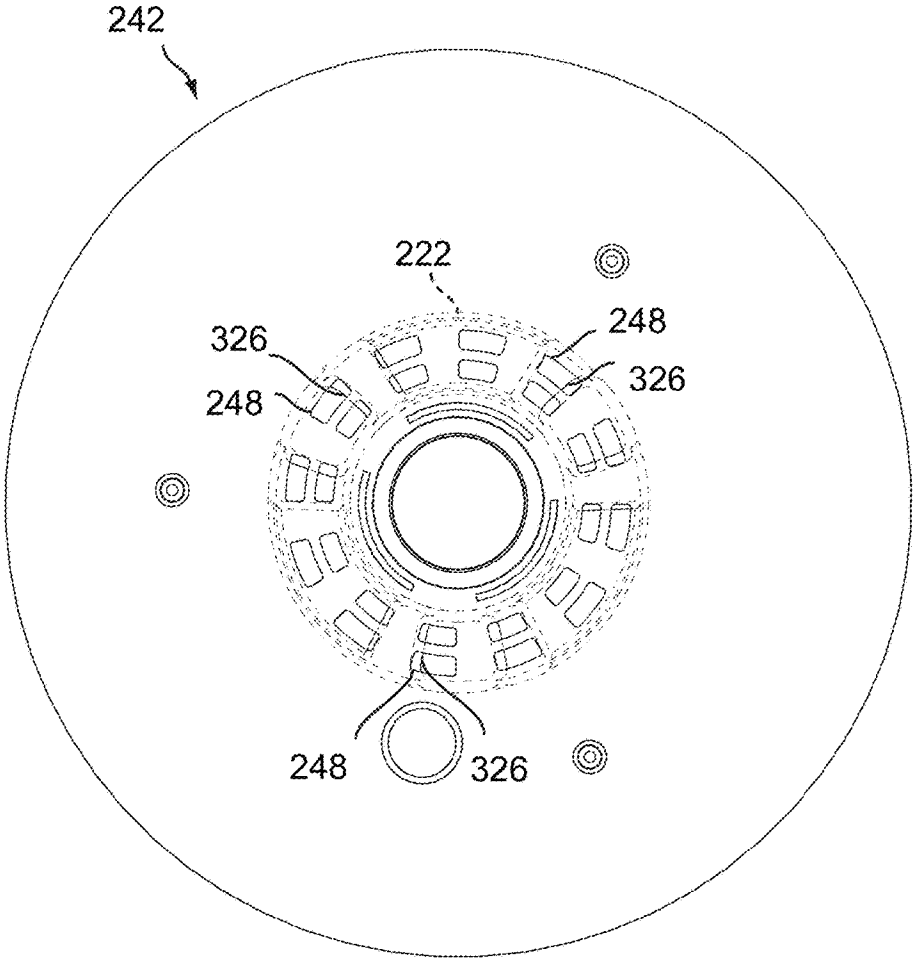
FIG. 31 is a bottom view of the distributor positioned 30% out of mode with respect to the valve.
Figure 32:
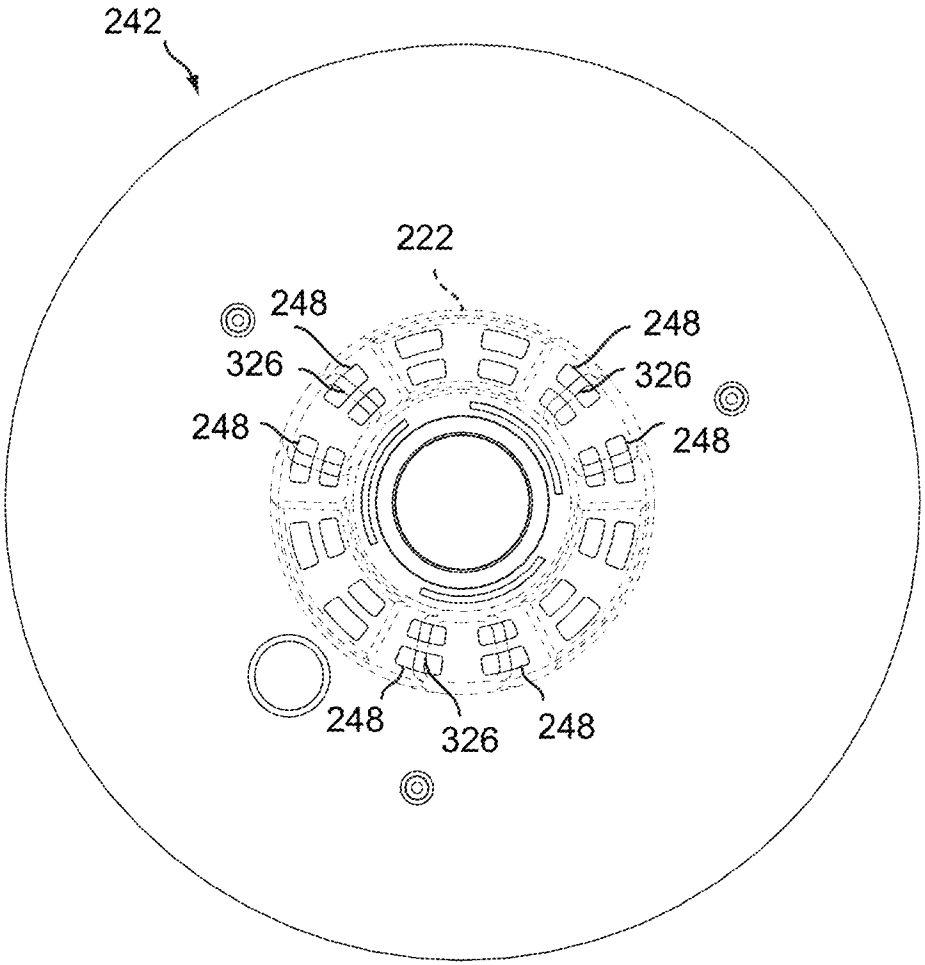
FIG. 32 is a bottom view of the distributor positioned 60% out of mode with respect to the valve.
Figure 33:
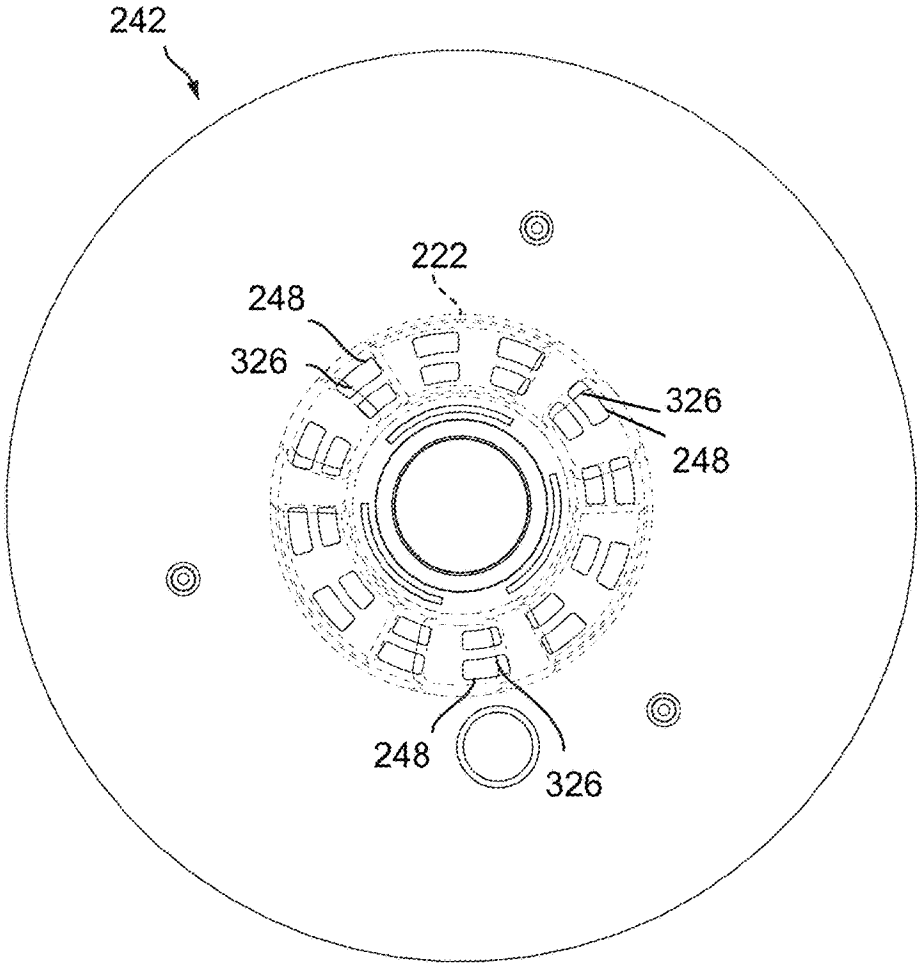
FIG. 33 is a bottom view of the distributor positioned 90% out of mode with respect to the valve.

FIGS. 31-33 illustrate the ports 248 of the spray engine 212 during a mode change between adjacent discrete positions, i.e., transitioning between a first discrete position (and first spray mode) in which one set of ports 248 is aligned with the (three) water flow ports 326 and an adjacent second discrete position (and adjacent second spray mode) in which the adjacent set of ports 248 is aligned with the water flow ports 326. The mode change operation of the spray engine 212 is similar to that described above for the spray engine 12 and as illustrated in FIGS. 16-18.

As illustrated in FIGS. 1-4, 8A and 19-20, the spray face 38, 238 has a pattern 150, 350. The patterns 150, 350 are similar, and only the pattern 150 will be described in detail.

In the illustrated construction, the pattern 150 is formed by variations in thickness of the spray face 38 (e.g., facets 152) forming edges 154 and shapes 156 bounded by the edges 154. The edges 154 may be straight or curved. Two adjacent facets 152, or shapes 156, meet at an edge 154. Three or more adjacent facets 152, or shapes 156, meet at an intersection 158.

The facets 152 may include concave surfaces, convex surfaces, or flat surfaces and may have a variety of shapes (e.g., circle, triangle, square, diamond, trapezoid, polygon, non-polygon, etc.). In the illustrated construction (see FIG. 8A), the pattern 150 includes trapezoidal-shaped facets 152. In the illustrated construction, the facets 152 are generally the same (shape, size, etc.), while, in other constructions (not shown), the facets 152 are different.

In the illustrated construction, the facets 152 are arranged radially about a center 160 of the spray face 38 at different radial distances from the center 160. In some constructions (not shown), different facets (e.g., by shape, size) may be arranged in different groups at different radial distances.

In some constructions, the pattern 150 of facets 152 may be formed from ridges or grooves in the material of the spray face 38 forming edges 154 and shapes 156 bounded by the edges 154. In other constructions (not shown), the pattern 150 of facets 152 may be painted or printed onto the spray face 38 (or within the material of the spray face 38) to form edges 154 and shapes 156 bounded by the edges 154. Other variations for forming the pattern 150 of facets 152 to form edges 154 and shapes 156, or the illusion of edges 154 and shapes 156, may be employed. For example, the pattern 150 of facets 152 may appear to be formed from a plurality of lines that appear to intersect, forming the facets 152 therebetween. Such lines may be straight or curved.

At least some of the nozzles (e.g., nozzles 80, 82, 84) may be located at intersections 158 of the pattern 150. This arrangement may provide for simple and accurate locating of the nozzles in the spray face 38. Formation of nozzles through the increased material at the intersections 158 may ensure strength of the spray face. However, it is not necessary for every intersection 158 of the pattern 150 to include a nozzle, and it is not necessary for each nozzle to be positioned at an intersection 158 of the pattern 150.

Thus, the invention may generally provide a shower device having a spray engine that is rotatable for changing a spray mode. The spray engine may include an elastomeric layer for improving the grip/friction of the spray engine during rotation in a wet environment. The elastomeric layer may cover the front, sides and extend around at least a portion of the rear of the spray engine so a user may grip at least the sides (i.e., the outermost circumference) of the spray engine to facilitate gripping and rotating the spray engine, which does not include a lever to facilitate rotation.

The invention may also provide a multi-mode shower device including a valve having at least one port, mode isolators and an integrated spill cover defined by at least one raised sealing surface, the valve communicating a fluid from a fluid supply to a relatively-pivotable spray engine having an inlet port for each spray mode. In addition, the invention may provide a multi-mode shower device a conduit for a first spray mode passing through a plenum of a second spray mode and to an outlet of the first spray mode, the conduit being completely surrounded by the plenum as it passes through the plenum.

Further, the invention may provide a multi-mode shower device providing an aerated spray mode and another non-aerated spray mode. Also, the invention may provide a faceplate for a shower device having a surface with a pattern of intersecting lines. A plurality of apertures may extend through the faceplate to allow water to flow therethrough, and at least one aperture may be positioned at an intersection of lines. In addition, the invention may provide a multi-layer spray face including a base layer and a covering layer, one layer (e.g., the base layer) being common to separate spray faces, the other layer (e.g., the covering layer) being different (e.g., surface pattern, color, graphics, spray modes (certain nozzles provided or not), etc.) between the separate spray faces.

What is claimed is:

1. A multi-mode shower device comprising:

a housing defining an inlet connectable to a water supply;

a valve including a valve body defining a valve port in fluid communication with the inlet, the valve body including a mode isolator adjacent the valve port, a raised sealing surface being formed between the valve port and the mode isolator, the valve body being formed as a single piece of material;

the mode isolator, the raised sealing surface, and the valve port being formed on the single piece of material of the valve body; and a spray engine supported for pivoting movement relative to the valve to change a mode of the shower device, the spray engine providing a spray face having a first outlet and a second outlet, the spray engine defining a first inlet port and a second inlet port;

in a first shower mode position of the spray face relative to the valve, the first inlet port being aligned with the valve port to provide a first shower mode through the first outlet and the second inlet port being misaligned with the valve port and at least partially aligned with the mode isolator to substantially prevent flow through the second outlet;

in a second shower mode position of the spray face relative to the valve, the second inlet port being aligned with the valve port to provide a second shower mode through the second outlet and the first inlet port being misaligned with the valve port;

in an intermediate shower mode position of the spray face relative to the valve, the first inlet port being at least partially aligned with the valve port to provide the first shower mode through the first outlet and the second inlet port being at least partially aligned with the valve port to provide the second shower mode through the second outlet.

2. The shower device of claim 1, wherein the valve body includes, on opposite sides of the valve port, a first mode isolator and a second mode isolator, in the intermediate shower mode position of the spray face relative to the valve, the first inlet port being at least partially aligned with each of the valve port and the first mode isolator and the second inlet port being at least partially aligned with each of the valve port and the second mode isolator.

3. The shower device of claim 1, wherein the spray face has a third outlet, wherein the spray engine defines a third inlet port, and wherein the valve body includes an integrated spill cover adjacent the mode isolator, in the first shower mode position of the spray face relative to the valve, the third port being aligned with the integrated spill to substantially prevent flow through the third outlet.

4. The shower device of claim 3, wherein the spray face has a fourth outlet, wherein the spray engine defines a fourth inlet port, and wherein the valve body includes, on opposite sides of the valve port, a first mode isolator and a second mode isolator, in the first shower mode position of the spray face relative to the valve, the second inlet port being misaligned with the valve port and at least partially aligned with the first mode isolator to substantially prevent flow through the second outlet and the fourth inlet port being misaligned with the valve port and at least partially aligned with the second mode isolator to substantially prevent flow through the fourth outlet.

5. The shower device of claim 3, wherein adjacent ones of the valve port, the mode isolator and the integrated spill cover are separated by the raised sealing surface.

6. The shower device of claim 5, wherein the valve port, the mode isolator and the integrated spill cover are positioned about a circumference of the valve body.

7. The shower device of claim 1, wherein the valve body defines a first valve port and a second valve port and includes a first mode isolator adjacent the first valve port and a second mode isolator adjacent the second valve port, the spray engine defining a pair of first inlet ports and a pair of second inlet ports.

8. The shower device of claim 7, wherein the valve body includes a pair of first mode isolators, one adjacent each opposite side of the first valve port, and a pair of second mode isolators, one adjacent each opposite side of the second valve port.

9. The shower device of claim 8, wherein the valve includes an integrated spill cover adjacent to and between one first mode isolator and one second mode isolator.

10. The shower device of claim 9, wherein the valve body defines three valve ports and includes three pair of mode isolators, one of each pair being on one side of an associated valve port, the other of each pair being on the other side of the associated valve port, and three integrated spill covers, each integrated spill cover being adjacent to and between two adjacent mode isolators.

11. The shower device of claim 7, wherein, in the first shower mode position of the spray face relative to the valve, one first inlet port is aligned with the first valve port and the other first inlet port is aligned with the second valve port to provide a first shower mode through the first outlet, one second inlet port being misaligned with the first valve port and at least partially aligned with the first mode isolator and the other second inlet port being misaligned with the second valve port and at least partially aligned with the second mode isolator to substantially prevent flow through the second outlet;

wherein, in the second shower mode position of the spray face relative to the valve, one second inlet port is aligned with the first valve port and the other second inlet port is aligned with the second valve port to provide a second shower mode through the second outlet, one first inlet port being misaligned with the first valve port and at least partially aligned with the first mode isolator and the other first inlet port being misaligned with the second valve port and at least partially aligned with the second mode isolator to substantially prevent flow through the first outlet; and wherein, in the intermediate shower mode position of the spray face relative to the valve, one first inlet port is at least partially aligned with the first valve port and the other first inlet port is at least partially aligned with the second valve port to provide the first shower mode through the first outlet and one second inlet port is at least partially aligned with the first valve port and the other second inlet port is at least partially aligned with the second valve port to provide the second shower mode through the second outlet.

12. A multi-mode shower device comprising:

a housing defining an inlet connectable to a water supply and a housing port in fluid communication with the inlet; and a spray engine supported by the housing and operable to change a mode of the shower device, the spray engine providing a spray face having a first outlet and a plurality of second outlets, the plurality of second outlets being arranged in an annular zone on the spray face, the first outlet being positioned in the annular zone, at least one second outlet being positioned radially inwardly of the first outlet and at least one second outlet being positioned radially outwardly of the first outlet, the spray engine defining a plurality of inlet ports including a first inlet port in fluid communication with the first outlet and a second inlet port in fluid communication with the plurality of second outlets, wherein the plurality of inlet ports are evenly spaced in a generally circular arrangement;

in a first shower mode, the first inlet port being axially aligned with the housing port to provide flow to the first outlet;

in a second shower mode, the second inlet port being axially aligned with the housing port to provide flow to the second outlets;

wherein the spray engine defines a first passageway communicating between the first inlet port and the first outlet and a plenum communicating between the second inlet port and the second outlets, the first passageway including a conduit passing through the plenum and to the first outlet, the conduit being completely surrounded by the plenum as the conduit passes through the plenum;

in the first shower mode, the first inlet port being axially aligned with the housing port to provide flow through the first passageway to the first outlet;

in the second shower mode, the second inlet port being axially aligned with the housing port to provide flow through the plenum to the second outlets.

13. The shower device of claim 12, wherein the plurality of second outlets is distributed around the first outlet.

14. The shower device of claim 12, wherein the spray engine is supported for pivoting movement relative to the housing to change a mode of the shower device.

15. The shower device of claim 12, wherein the spray face has a plurality of first outlets, and wherein the spray engine defines a plurality of first passageways, each communicating between the first inlet port and an associated one of the first outlets, each first passageway including a conduit passing through the plenum to the associated one of the first outlets, each conduit being completely surrounded by the plenum as the conduit passes through the plenum.

16. The shower device of claim 15, wherein the plurality of second outlets is distributed about each first outlet.

17. The shower device of claim 12, wherein the spray engine includes an elastomeric layer providing the spray face and defining the first outlet and a support layer having a first surface engaging the elastomeric layer and an opposite, second surface, the support layer defining an opening between the first surface and the second surface, material of the elastomeric layer extending from the spray face, through the opening and to the second surface, the material providing an integrated seal on the second surface of the support layer.

* * * * *